US007163130B2

(12) United States Patent
Lafond

(10) Patent No.: US 7,163,130 B2
(45) Date of Patent: Jan. 16, 2007

(54) PORTABLE GAS POWERED FLUID DISPENSER

(76) Inventor: Luc Marcel Lafond, 23 Woodvalley Drive, Etobicoke, Ontario (CA) M9A 4H4

( * ) Notice: Subject to any disclaimer, the term of this patent is extended or adjusted under 35 U.S.C. 154(b) by 0 days.

(21) Appl. No.: 10/629,270

(22) Filed: Jul. 29, 2003

(65) Prior Publication Data

US 2004/0074927 A1 Apr. 22, 2004

Related U.S. Application Data

(60) Provisional application No. 60/419,114, filed on Oct. 18, 2002, provisional application No. 60/451,281, filed on Mar. 4, 2003.

(51) Int. Cl.
*B67D 5/40* (2006.01)

(52) U.S. Cl. ..... 222/326; 222/380; 222/389; 222/401

(58) Field of Classification Search ..... 222/326, 222/327, 380, 389, 401, 402, 507, 516
See application file for complete search history.

(56) References Cited

U.S. PATENT DOCUMENTS

| | | | | |
|---|---|---|---|---|
| 599,383 A | | 2/1898 | Bunnell et al. | |
| 1,403,197 A | * | 1/1922 | Rieck | 222/516 |
| 1,499,642 A | * | 7/1924 | Craig | 141/26 |
| 2,142,081 A | | 1/1939 | Olive | |
| 2,450,029 A | | 9/1948 | Wells | |
| 2,493,677 A | * | 1/1950 | Lofstrand, Jr. | 222/402 |

(Continued)

FOREIGN PATENT DOCUMENTS

DE 29 44 969 A1 5/1980

(Continued)

OTHER PUBLICATIONS www.tah.com/display—website for TAH Industries, "Cartridge Systems" dtd. Feb. 10, 2003.

(Continued)

*Primary Examiner*—Joseph A. Kaufman
(74) *Attorney, Agent, or Firm*—Smith, Gambrell & Russell, LLP

(57) ABSTRACT

A caulking gun has a tubular chamber to surround sleeve-like rigid tubes and compressible sausage type containers containing viscous materials including sealants, adhesives, caulking, mastics and the like. When rigid tubes are loaded into the chamber, compressed gas is allowed to surround the sleeve and a plunger loaded within the rigid tube to equalize pressure around the outside of the rigid tube. If a sausage type container is loaded into the chamber, a removable plunger is also provided to form a tight seal between the perimeter of the plunger and the inner surface of the chamber. Compressed gas introduced into the chamber preferentially acts on the plunger and an underlying end wall of the sausage to expel the material, without imparting any significant pressure to other parts of the sausage. The caulking gun includes a variable flow rate nozzle which may be removed from the device. The nozzle may be replaced with similar or different nozzle pieces of various shapes and sizes, if desired. Hand operated controls vary the flow rate through the nozzle and control introduction of compressed gas when in use. These features may be incorporated into other portable, hand held dispensing devices powered by other pressurized fluids.

80 Claims, 17 Drawing Sheets

U.S. PATENT DOCUMENTS

| | | | | |
|---|---|---|---|---|
| 2,537,358 | A | | 1/1951 | Lincoln |
| 2,563,636 | A | | 8/1951 | Ballard |
| 2,692,706 | A | | 10/1954 | Wiksten |
| 2,818,999 | A | | 1/1958 | Miller et al. |
| 2,821,193 | A | | 1/1958 | Ziherl et al. |
| 3,138,303 | A | | 6/1964 | Hoveland |
| 3,308,998 | A | | 3/1967 | Oppaser et al. |
| 3,379,188 | A | | 4/1968 | Walther |
| 3,568,892 | A | | 3/1971 | Burk |
| 3,587,930 | A | | 6/1971 | Schultz et al. |
| 3,640,431 | A | | 2/1972 | Plumer |
| 3,805,783 | A | | 4/1974 | Ismach |
| RE28,120 | E | | 8/1974 | Plumer |
| 3,877,610 | A | | 4/1975 | Dickey |
| 3,980,209 | A | | 9/1976 | Collar |
| 3,983,947 | A | | 10/1976 | Wills et al. |
| 3,987,939 | A | | 10/1976 | Pedone, Jr. et al. |
| 4,174,068 | A | | 11/1979 | Rudolph |
| 4,284,213 | A | | 8/1981 | Lee |
| 4,299,336 | A | | 11/1981 | Studer |
| 4,340,154 | A | | 7/1982 | VanManen |
| 4,376,498 | A | | 3/1983 | Davis, Jr. |
| 4,382,530 | A | | 5/1983 | Calisto |
| 4,386,717 | A | | 6/1983 | Koob |
| 4,426,022 | A | | 1/1984 | Lang et al. |
| 4,441,629 | A | | 4/1984 | Mackal |
| 4,453,651 | A | | 6/1984 | Braithwaite et al. |
| 4,461,454 | A | | 7/1984 | Vadnais |
| 4,637,531 | A | | 1/1987 | Olsson |
| 4,685,595 | A | | 8/1987 | Segatz |
| 4,773,566 | A | * | 9/1988 | Hoagland ..... 222/146.5 |
| 4,802,607 | A | | 2/1989 | Johnson |
| 4,844,301 | A | | 7/1989 | Juillet |
| D303,914 | S | | 10/1989 | Hinden et al. |
| 4,925,061 | A | | 5/1990 | Jeromson, Jr. et al. |
| 4,932,094 | A | | 6/1990 | McCowin |
| 4,957,225 | A | | 9/1990 | Childers |
| 4,986,444 | A | | 1/1991 | Corso |
| 5,015,233 | A | | 5/1991 | McGough et al. |
| 5,058,769 | A | | 10/1991 | Kurtz |
| D321,309 | S | | 11/1991 | Myers |
| 5,064,098 | A | | 11/1991 | Hutter, III et al. |
| 5,104,013 | A | | 4/1992 | Hawley |
| 5,163,584 | A | * | 11/1992 | Huber et al. ..... 222/1 |
| 5,181,636 | A | | 1/1993 | Anderson et al. |
| 5,203,507 | A | | 4/1993 | Matthews |
| 5,203,839 | A | | 4/1993 | Skaggs |
| D341,396 | S | | 11/1993 | Salmon et al. |
| D342,654 | S | | 12/1993 | Jens |
| D343,103 | S | | 1/1994 | Bunce |
| 5,297,697 | A | | 3/1994 | Boring |
| 5,339,987 | A | | 8/1994 | D'Andrade |
| 5,361,941 | A | | 11/1994 | Parekh et al. |
| 5,363,834 | A | | 11/1994 | Stuchlik |
| 5,370,271 | A | | 12/1994 | Segatz |
| D357,392 | S | | 4/1995 | Kimpel et al. |
| 5,411,180 | A | | 5/1995 | Dumelle |
| 5,443,370 | A | | 8/1995 | Wang |
| 5,492,249 | A | | 2/1996 | Beach |
| 5,535,925 | A | | 7/1996 | Hinden et al. |
| 5,573,148 | A | | 11/1996 | Poole et al. |
| 5,622,159 | A | | 4/1997 | Liu et al. |
| 5,699,780 | A | | 12/1997 | Bissonnette |
| 5,833,099 | A | | 11/1998 | Boaz et al. |
| 5,860,568 | A | | 1/1999 | Mallalieu et al. |
| 5,873,705 | A | | 2/1999 | Chen |
| 6,022,504 | A | | 2/2000 | Boaz et al. |
| 6,032,830 | A | | 3/2000 | Brown |
| 6,039,223 | A | | 3/2000 | Damask |
| 6,056,156 | A | | 5/2000 | Peng |
| 6,062,428 | A | | 5/2000 | Callahan |
| 6,193,107 | B1 | | 2/2001 | D'Andrade |
| 6,299,078 | B1 | | 10/2001 | Fugere |
| 6,422,427 | B1 | | 7/2002 | Brown et al. |
| 2004/0084482 | A1 | | 5/2004 | Sumner et al. |
| 2004/0169052 | A1 | | 9/2004 | Wu |

FOREIGN PATENT DOCUMENTS

| | | | |
|---|---|---|---|
| DE | 34 09 724 | A1 | 9/1985 |
| DE | 35 26 141 | A1 | 2/1986 |
| DE | 35 26 142 | A1 | 2/1986 |
| DE | 85 29 712.7 | U1 | 1/1988 |
| DE | 39 20 694 | A1 | 1/1991 |
| DE | 94 19 733.4 | U1 | 4/1995 |
| EP | 0 056 310 | A2 | 7/1982 |
| EP | 0 290 259 | A2 | 11/1988 |
| GB | 2 162 902 | A | 2/1986 |
| GB | 2 162 903 | A | 2/1986 |
| IT | 1 187 996 | | 12/1987 |
| JP | 62-011571 | | 1/1987 |
| JP | 64-038164 | | 2/1989 |
| JP | 02-144168 | | 6/1990 |
| JP | 06-000428 | | 1/1994 |
| JP | 06-099122 | | 4/1994 |
| JP | 06-235261 | | 8/1994 |
| JP | 09-024981 | | 1/1997 |
| JP | 2001-315864 | | 11/2001 |
| NL | 9200318 | | 9/1993 |

OTHER PUBLICATIONS www.staticmixerdispenser.com—website for Brandywine Associates, "Dispensing and Mixing Systems for Adhesives and Chemicals"; "Dispensing Guns For Two Part Adhesives and Sealants" dtd. Feb. 10, 2003.

"EssexPak System Saves Time Money", (Glass Digest) dtd. May 15, 2001.

"CRL Introduces New Sealant and Caulking Gun Duo" (USGlass, Metal & Glazing) dtd. Mar., 2001.

www.profil-clip.de/dichtstoffe.html—website for Profi-Clip dtd. Apr. 28, 2003.

* cited by examiner

PORTABLE GAS POWERED FLUID DISPENSER

CROSS-REFERENCE TO RELATED APPLICATIONS

This application claims the benefit of U.S. provisional patent application Nos. 60/419,114, filed Oct. 18, 2002 entitled "Caulking Gun Powered by Pressurized Fluid" and 60/451,281, filed Mar. 4, 2003 entitled "Nozzle for Dispensable Viscous Materials" respectively.

FIELD OF THE INVENTION

The following invention relates to portable, powered fluid dispensers, including caulking guns and other devices for dispensing viscous materials, including sealants, lubricants, pastes, epoxies, and other viscous materials. The present invention includes caulking guns, grease guns and other dispensers for viscous materials. The dispensing devices of the present invention will have application in various residential, commercial, construction and industrial applications in which viscous materials will be dispensed.

BACKGROUND

Dispensable, viscous materials such as adhesives, epoxies, sealants, including caulking, pastes, lubricants, and other viscous materials are typically packaged in rigid, thermoplastic tubular containers, or spiral bound cardboard tubes. To some extent, although not as often, some of these viscous materials come pre-packaged in tubular, sausage type containers having a relatively strong, but flexible outer impermeable skin to encapsulate the viscous material.

The rigid containers are often provided with pre-attached nozzle tips made from a thermoplastic material that is sealed against entry of air and to prevent the viscous material from escaping from the container. An air seal may be provided between the main portion of the tube containing the viscous material, and the base of the hollow nozzle tip. A user will typically cut away a portion of the nozzle tip, to create an opening to dispense the viscous material, and then will pierce the air seal (through the newly created opening), so that when in use, the viscous material will enter the channel of the hollow nozzle and exit from the cut opening at the nozzle tip. The user will then try to carefully apply sufficient pressure to the contents of a caulking gun or other dispensing device to apply a uniform bead of material to a target surface. The inability to apply an uniform bead is a common problem associated with hand operated caulking guns, and powered dispensers fitted with conventional nozzles, including aerosol containers filled with dispensable materials such as caulking or other sealants.

Unfortunately, it is relatively difficult for inexperienced users and many trained workers to apply uniform beads of material over extended periods of time. Conventional hand operated devices are prone to significant variations in bead quality and appearance. Even if an operator is provided with a conventional, powered dispensing device, it is difficult for the operator to control the flow rate at which the viscous material is dispensed and deposited to a target area.

One of the most common types of existing tubular container designs includes the fixed, hollow nozzle tip made from polyethylene or other thermoplastic material, briefly described above. The nozzle tip is fixed to the container, and if the affixed, conventional nozzle tip is spoiled, plugged, or rendered unusable, the entire container must be thrown away because the user will not have a convenient, cost effective replacement for the spoiled nozzle tip. Furthermore, the prefixed nozzles are not provided with replaceable or interchangeable nozzle tips. Essentially, a user is not provided with a selection of interchangeable tips that could be used to dispense different shapes and sizes of beads.

There are many other disadvantages to using known conventional nozzle designs and conventional dispensing devices. By way of further example, but not by way of limitation, prefixed nozzles cannot be removed for cleaning and cannot be reused. Once the container is emptied, the container and the nozzle tip are discarded. There are also other disadvantages associated with prefixed nozzles in that the overall container size is greatly increased by the added length of the prefixed nozzle component. The added length makes it necessary for manufacturers and others to package the containers in relatively large boxes to accommodate the added space occupied by the nozzles. If the nozzle of a container is damaged during shipping or handling, the entire damaged container and its contents are typically discarded, resulting in significant losses and higher costs. Earlier nozzle designs of this type are not readily adaptable for use in dispensing viscous materials from sausage type containers. Furthermore, these conventional nozzle designs do not provide features to control the flow rate for dispensing the viscous materials from lightweight hand held dispensing devices, including caulking guns.

SUMMARY OF THE INVENTION

The present invention is adaptable for use with a wide variety of fluid containers, including caulking tubes and sausage-type containers, grease tubes, tubes containing sealants, adhesives, and mastics, prepackaged food stuffs in tube type containers, and the like. The invention may also be applied to handheld devices that may be powered by stationary compressors or battery powered portable air compressors, electrically powered hand tools and other dispensing devices. Although certain examples and embodiments of the invention will be explained in connection with caulking guns and hand held portable devices, including caulking guns, the invention may be embodied in many other devices and other equipment for dispensing viscous materials. For example, caulking guns may be used to dispense a wide variety of viscous materials for use in manufacturing, construction, repair and other applications and activities. In some instances, the hand held device may be powered by pressurized fluids other than pressurized gases such as air or $CO_2$. For example, it may be desirable to use embodiments of the invention in association with pressurized water lines or hoses supplying other pressurized liquids. Certain embodiments of the invention may be adapted for operative fluid connection with the lines or external reservoirs capable of providing pressurized fluid. In many instances, urban water systems include water lines capable of supplying flowing water pressurized in a range of about 30 psi to 60 psi pressure. The invention may be modified to accommodate a pressurized water source to adequately power the dispensing device to dispense a range of commonly used viscous materials at above-freezing temperatures. However, preferred embodiments of the invention include hand held dispensing devices powered by pressurized gases including air or $CO_2$. Preferably, the pressurized gases are charged in a storage reservoir provided within the device.

In one aspect, the invention is a hand held dispensing device defining a sealable chamber capable of preventing escape of pressurized operating fluids, including air or $CO_2$, water, or other fluids used to power the device. (For ease of reference, the terms "sealable chamber" and "sealable housing" include chambers and housings designed to inhibit unintended escape of various pressurized gases and other fluids.) The chamber is made to receive containers that are typically manufactured and supplied separately, apart from the dispensing device. The device receives these later acquired containers within the chamber. In some instances, the chamber may be varied (for example, by replacing an existing modular housing with another housing of different size and shape) to receive a different type or size of container. In some instances, the container may be a rigid tube defining a hollow sleeve. Typically, the rigid tube comes with a plunger loaded within the hollow sleeve, to expel the viscous material from the tube, when the plunger is subjected to load. In this case, the rigid tube and the plunger are loaded into the chamber together, and after use, the tube and the included plunger are removed from the chamber. It is preferred that pressurized fluids introduced into the chamber during operation (for example, compressed gas) will surround the sleeve and an exposed surface of the plunger so that there will be an equalization of pressure around the tube, to maintain a tight seal between the sleeve and the plunger positioned within the sleeve. In many instances, this feature will discourage the sleeve of the tube from ballooning outwardly to fill any gaps that may exist between the sleeve of the tube and the interior walls of the chamber. The equalizing pressurized gas surrounding the sleeve inhibits ballooning of the sleeve and possible movement of the inner wall of the sleeve away from the internal plunger. (By way of comparison, in earlier caulking gun designs, there is a tendency for such ballooning to occur, thus allowing pressurized gas to blow by the plunger of a caulking tube, bubble through the viscous fluid, and spoil the quality of the caulking bead being dispensed from the tube.)

In other instances, the chamber will be loaded with a container for viscous material that is a collapsible tube made with relatively thin, outer walls which may be folded as or when the container is emptied. Because the walls of these sausage type containers are still relatively flexible even when the container is filled, the containers will tend to fill the interior space of the chamber in the housing. Consequently, in many instances, the present device may be provided with a standard housing suitable for receiving the most common sizes of rigid tubes and sausage type containers. Where a collapsible tube is used, it is preferable to load a plunger piece into the chamber so that the plunger will press against one end of the sausage, to urge the viscous fluid to flow to a nozzle assembly. It is preferred that the plunger will form an air tight seal between itself and the interior wall of the surrounding chamber. An air tight seal should be provided to inhibit compressed gases or other pressurized fluids from by-passing the plunger, and interfering with the efficient expulsion of viscous material from the collapsible container. It is preferred that the compressed gases or other pressurized fluids will preferentially act upon an exposed surface of the plunger (and a corresponding end wall of the collapsible container), without imparting any significant pressure on other surfaces of the compressible container. If the plunger is not tightly sealed for sliding movement within the chamber, there may be a tendency for compressed fluids (for example, compressed gas) to by pass the plunger and flexible container and blow out of the nozzle, or create bubbles in the viscous material expelled from the dispensing device. It is also preferred that the plunger define a recess for gathering a folded portion of a collapsible container, as viscous material is expelled from that portion of the container. Preferably, the plunger piece may be removed from the chamber after use. A funnel may also be provided to fit over the other end of the collapsible container, to channel viscous material being expelled from the container, toward the nozzle assembly. A funnel may be used to minimize unwanted deposits of viscous material within the housing. After use of the collapsible container, the spent container and the funnel may be simultaneously withdrawn to prevent excess material from dirtying the interior of the housing. In other instances, it may be desirable to leave the funnel in place within the housing, if the operator expects to load the chamber with another container, or if the funnel is clean enough for later use.

As noted, the device also includes a nozzle assembly for fluid communication with the container for a dispensable viscous fluid. The nozzle assembly includes a base that can be secured, fastened or operatively associated for fluid communication with a container for a dispensable viscous material. Preferably, the nozzle assembly is securable to the container or to the dispensing device, to inhibit seepage or escape of the viscous material. In certain embodiments, the nozzle assembly will not be secured or fixed to either piece, when installed within the device, but the nozzle assembly will be positioned in a manner that will direct an enclosed flow of the viscous material from the container to the dispensing tip of the nozzle assembly. In some aspects, the body of the nozzle assembly defines a housing for a valve gate. The gate operates between a first (fully open) position, and a second (fully closed) position. The gate may also be positioned in a range of positions between the first and second positions, to provide a variable flow rate of viscous material through the nozzle assembly. The valve gate may be a rotating spindle, a sliding gate, or other structure capable of providing a range of valve openings between fully open and fully closed positions. The device may also include a variable flow control element, such as for example, a finger activated trigger. Other embodiments may include different control elements. For example, separate controls may be provided to control the flow rate of viscous material exiting from the nozzle assembly and pressurized fluids moving through the conduit.

In certain embodiments, a hand operated first control may be used to operate a valve (for example, the valve gate) throughout a range of positions, to impart a variable flow rate through the nozzle assembly. That hand operated first control may include a linkage between a hand operated element (for example, a finger operated trigger) and an actuator for the valve gate. In some of the embodiments illustrated further below, several flexible guides (including flexible strap portions) are described. However, many other linkages are possible for use as suitable hand operated control features.

In another aspect, the nozzle assembly is detachable from the container or dispensing device. In a preferred embodiment, the base of the nozzle assembly is attached to a container for viscous fluid (or to the dispensing device). Although the nozzle base may also be detachable from the container (or dispensing device), the assembly includes a detachable nozzle tip which is attached to the nozzle base for operation, and is detached from the nozzle base, for replacement with another interchangeable tip, or for storage. An optional reclosure cap may also be provided. The reclosure cap may be provided with two portions. A first portion of the reclosure cap may be used to cover the opening of the nozzle tip piece, and a second portion of the reclosure cap may be used to cover an opening on the base of the nozzle assembly.

In another aspect, the detachable nozzle tip may be interchangeable with one or more nozzle tips capable of dispensing beads of different shapes and sizes.

In yet another aspect of the invention, the device may include a nozzle assembly provided with a feature to mount the nozzle assembly for use in connection with a conventional container such as a caulking tube, sausage or other conventional container including a conventional, prefixed nozzle piece. The existing prefixed nozzle piece on a conventional container may be trimmed or cut away, to leave a mounting stem. The nozzle assembly may be secured to the remaining stem on the viscous fluid container, or the nozzle assembly may be operatively associated in some other way with the container to allow fluid communication between the container contents and the nozzle assembly.

In certain embodiments of the invention, a tapered interior fluid channel is defined by the interior of the nozzle assembly, including an alignable opening in the valve gate, so that a continuous, tapered channel is provided along the longitudinal axis of the assembly, extending from the base of the assembly to the dispensing end. A simple, reusable or disposable cleaning tool with a matching taper may be used to clean the channel after use.

Although many embodiments of the invention may be manufactured for use with disposable nozzles made from inexpensive and lightweight materials, for disposal after a single use, other embodiments may be provided with reusable nozzle assemblies, and related components, for prolonged or repeated use, where it is desirable to do so.

In another aspect the invention includes a dispensing device (for example, a caulking gun) comprising:

- a sealable tubular housing, extending along a first longitudinal axis, between a dispensing end and an opposing end, for receiving a coaxially aligned tubular container of dispensable viscous fluid;
- a nozzle assembly adjacent the dispensing end, for viscous fluid communication with the tubular container, the nozzle assembly comprising a nozzle valve operating between an open position and a closed position;
- a control for operating the nozzle valve between the open and closed positions;
- a reservoir for storing compressed air;
- a conduit for communication of the compressed air between the reservoir and the housing to express the viscous fluid from within the housing; and
- a hand operated pump to supply the compressed air to the reservoir.

In another aspect, the dispensing device may be designed to couple with a detachable compressed air source, for example, a hand operated air pump. In that case, the reservoir will be used to store compressed air received from the detachable air source, (for example, a hand operated air pump).

In another aspect, the invention may be used with a nozzle assembly (or components of the nozzle assembly, such as the nozzle base) that will come fixed to the viscous fluid container. In other instances, durable, wear resistant components of the assembly may come fixed to the dispensing device, as part of an OEM dispensing device. Some or all of the components in the nozzle assembly may be replaceable.

The dispensing device of the present invention may provide one or more of the following advantages or other advantages which will become apparent upon a review of the present specification. By way of an example, one or more of the following advantages may be obtained:

- Various embodiments of the dispensing device will dispense viscous materials at a variable flow rate. The dispensing device may include compatible nozzle assemblies, or nozzle tips and replaceable components.
- Certain embodiments of the invention will be adaptable for use with rigid, tube type containers and with sausage type containers for dispensable fluids.
- In some instances, a compatible reusable, and reattachable nozzle assembly may be provided, to be fully interchangeable with other nozzle components, and capable of providing variations in flow volumes, patterns and extruded bead sizes.
- In some instances, the device may include a fully interchangeable, disposable nozzle assembly suitable for use with a plurality of interchangeable nozzle tips.
- The dispensing device may be compatible with a range of pressurized fluid sources. For example, some devices may be compatible for charging with pressurized air from stationary or movable compressors, portable gas sources such as large, prefilled cylinders or vessels, hand operated air pumps, and other externally powered sources. In some instances, it may be desirable to provide a reservoir to receive a pressurized $CO_2$ cartridge, or other filled gas cylinder.
- A reservoir to store compressed gas may be provided with a compartment defined by the dispensing device. The reservoir may be replenished occasionally with compressed gas by connecting the reservoir to an external compressed gas source. The reservoir may also be a modular unit suitable for replacement with different reservoirs, or permitting addition of supplementary reservoirs to increase the storage capacity for compressed gas.
- One or more of these advantages, or other advantages, may be available to those who use embodiments of the present invention.

The foregoing are only some examples of certain embodiments of the invention. Many other embodiments, variations and derivations will become apparent from a review of the entire description, including the appended drawings.

IN THE DRAWINGS

Certain specific embodiments of the invention will be described with reference to the following drawings in which:

FIG. 7D is a top view of the components of the fourth embodiment shown in

Figure 7A:
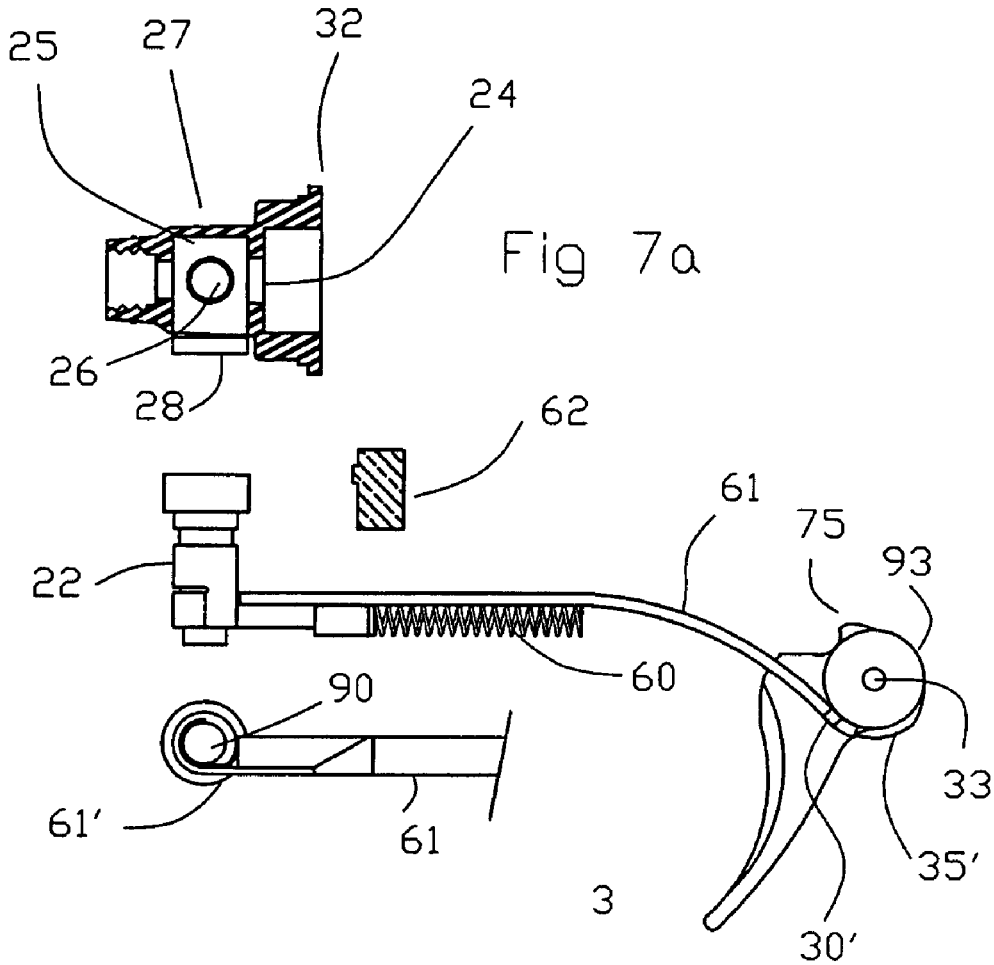
FIG. 7A is a partially exploded side view, in partial section, of certain components of the third embodiment shown in a first operating position.
Figure 7B:
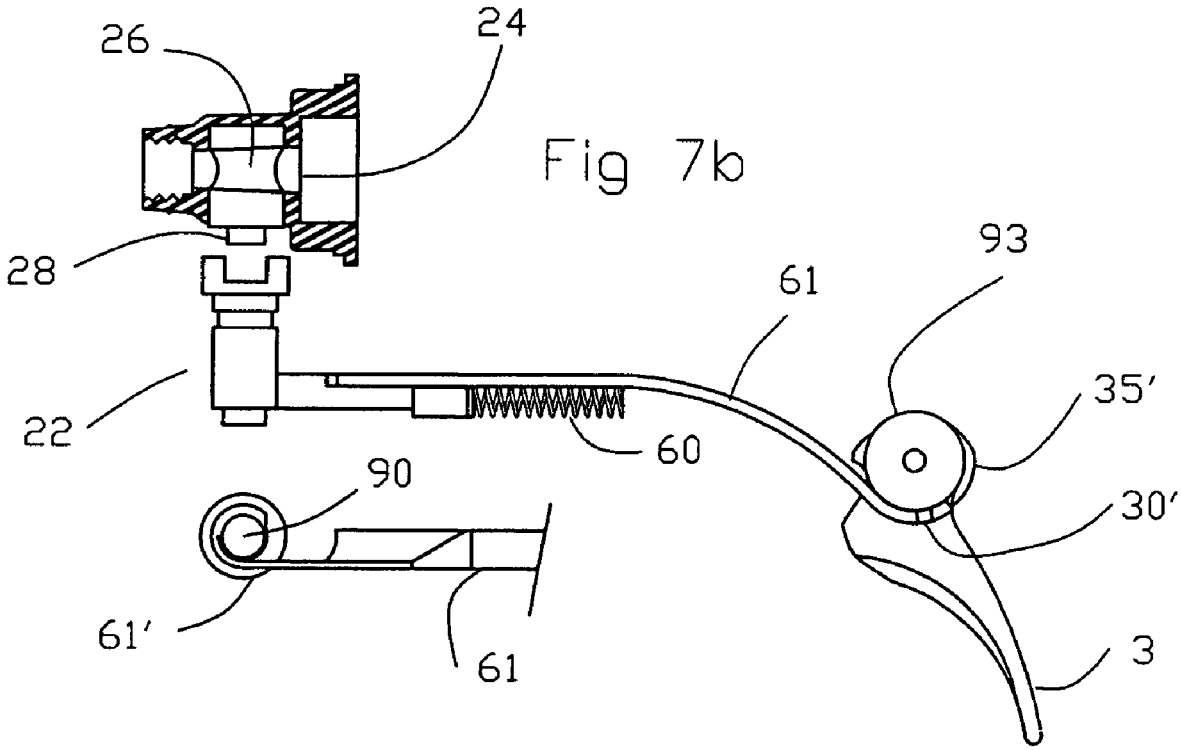
FIG. 7B is a partially exploded side view, in partial section, of certain components of the third embodiment shown in a second operating position.
Figure 7C:
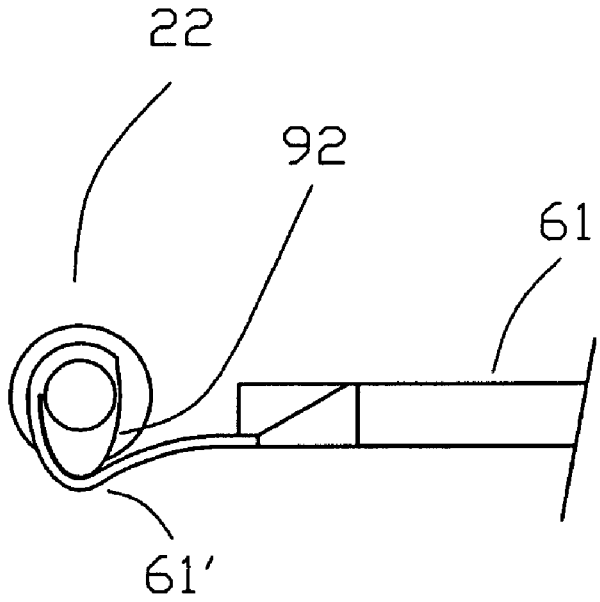
FIG. 7C is a top view of certain components of a fourth embodiment, shown in a first operating position.

FIG. 7C, in a second operating position.

Figure 7D:
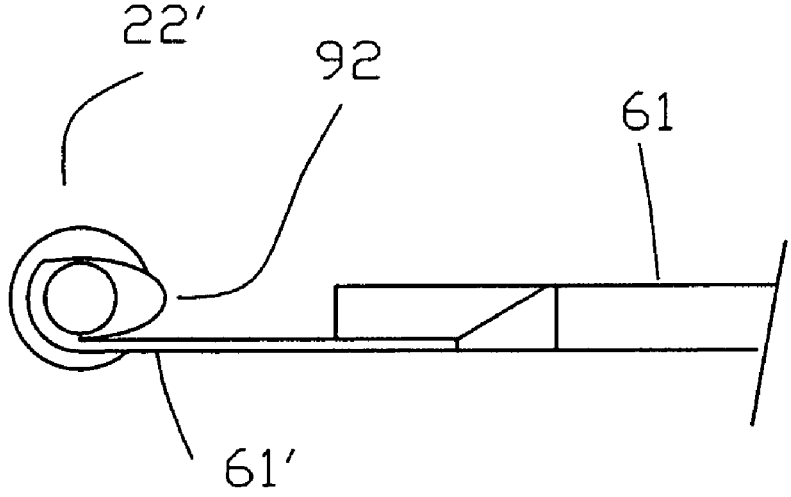
Figure 7E:
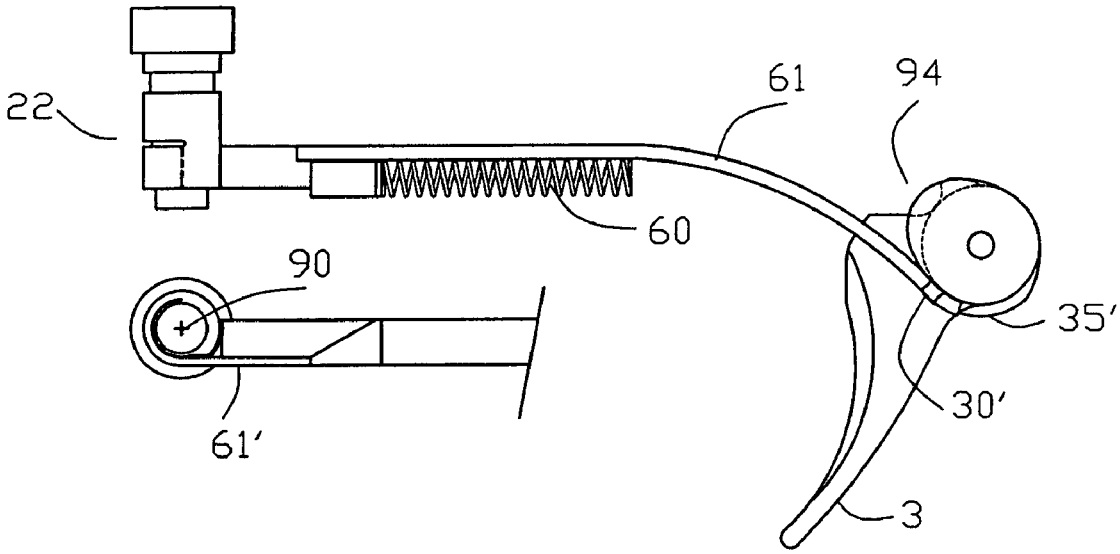

FIG. 7E is a side view (and a related top view, in partial section) of certain components of a fifth embodiment, shown in a first operating position.

Figure 7F:
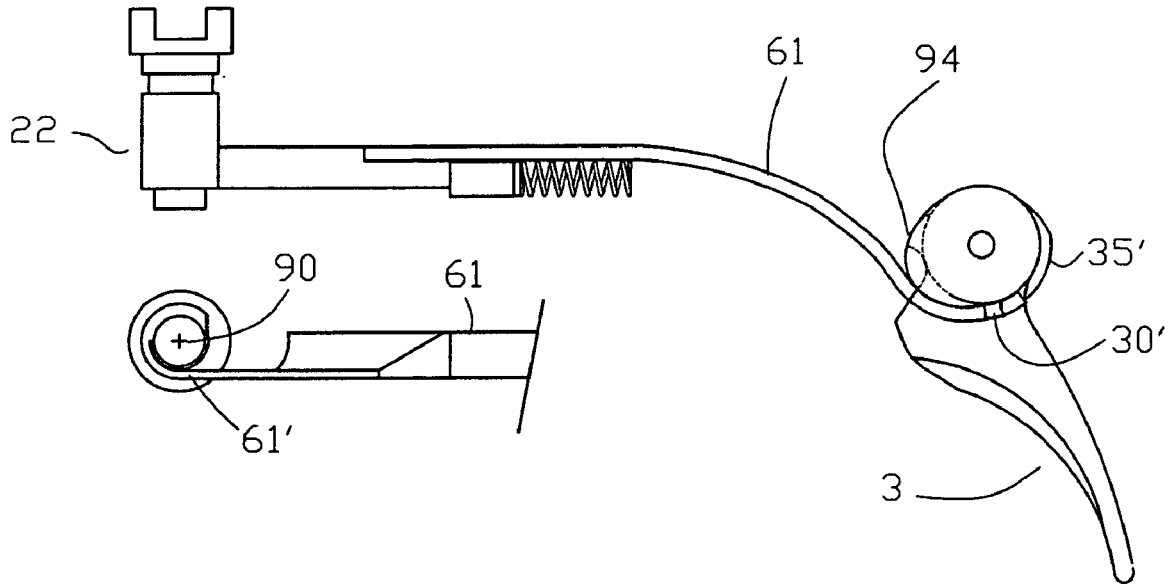

FIG. 7F is a side view (and a related top view, in partial section) of the components of the fifth embodiment, shown in a second operating position.

Figure 8:
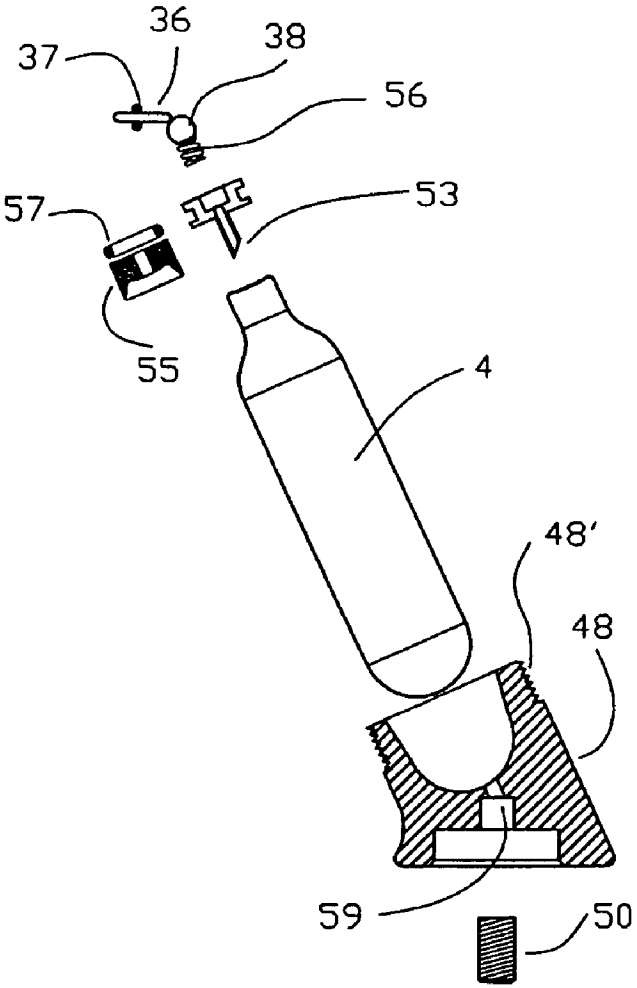
Figure 6:
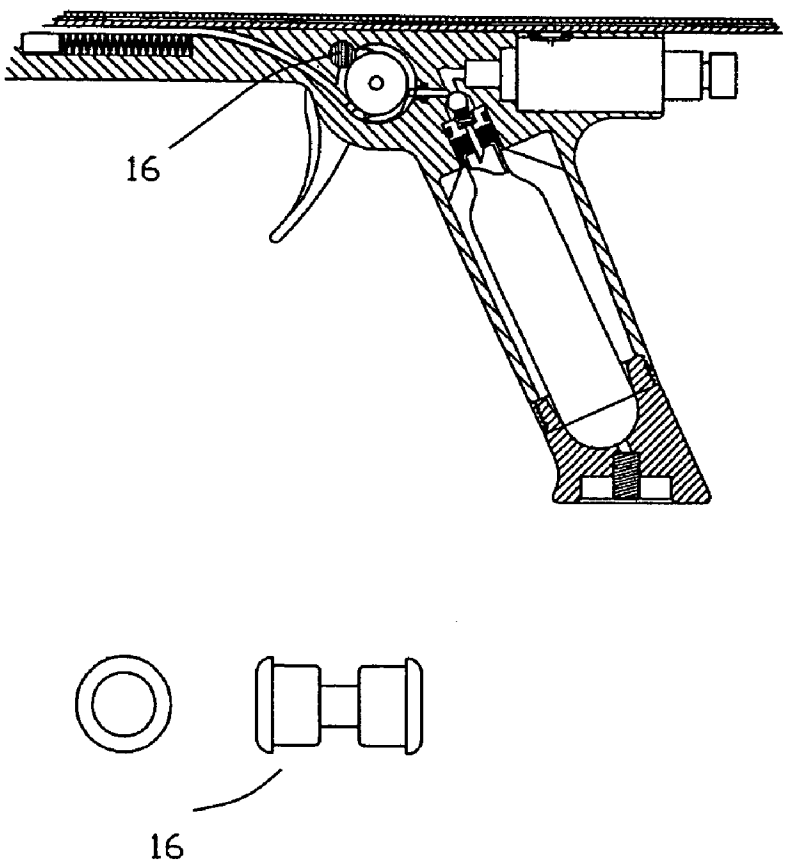
FIG. 6 is a partially exploded side view, in partial section, of the third embodiment shown in FIG. 5.

FIG. 8 is an exploded view, in partial section, of certain components of the first embodiment of the present invention.

Figure 9:
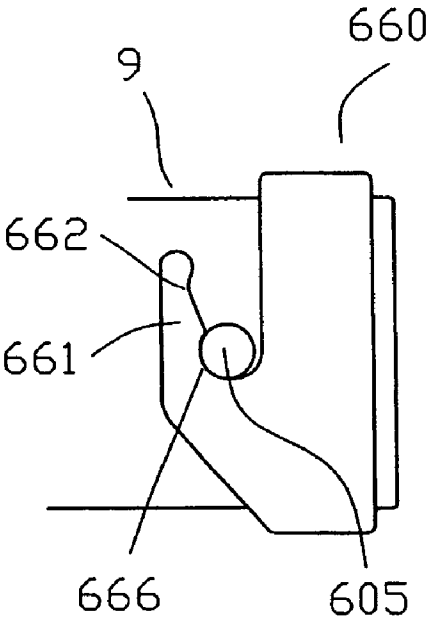

FIG. 9 is an enlarged side view of a closure cap in a sixth embodiment of the present invention.

Figure 10:
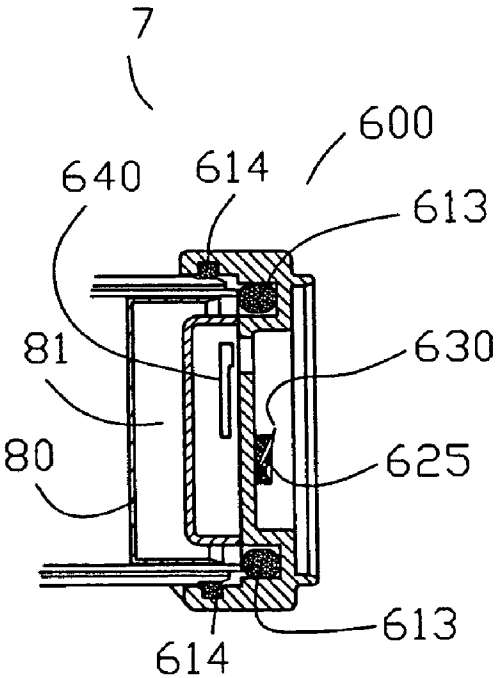

FIG. 10 is a side view of the closure cap of FIG. 9, shown in section, installed at the loading end of a dispensing device of the present invention.

Figure 11:
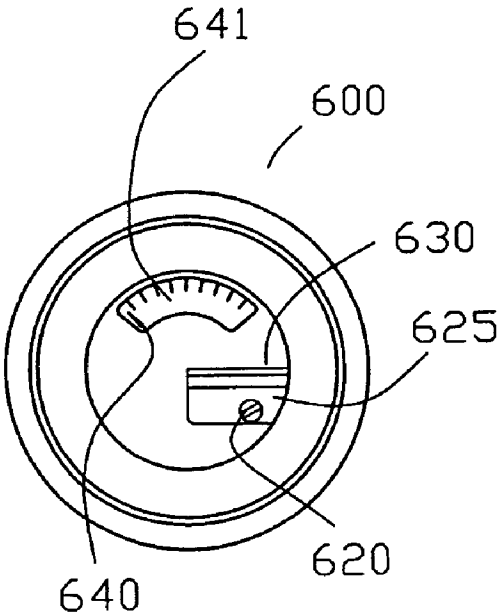

FIG. 11 is a right end view of the closure cap shown in FIGS. 9 and 10, installed in a dispensing device.

Figure 3B:
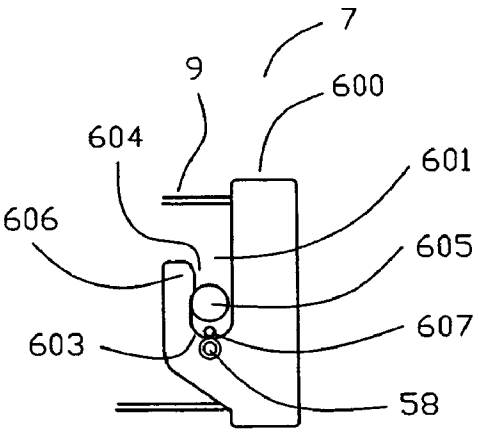
FIG. 3B is a partial sectional view of the closure cap of FIG. 3A, when the cap is in a partially open position.
Figure 3A:
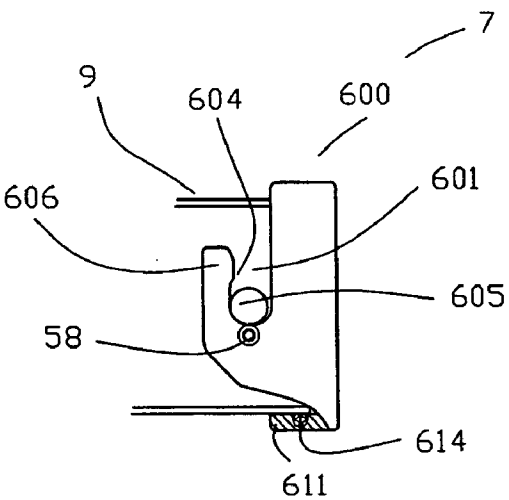
FIG. 3A is a partial sectional view of a closure cap at a loading end of the first embodiment of the invention, when the cap is in a closed position.
Figure 12A:
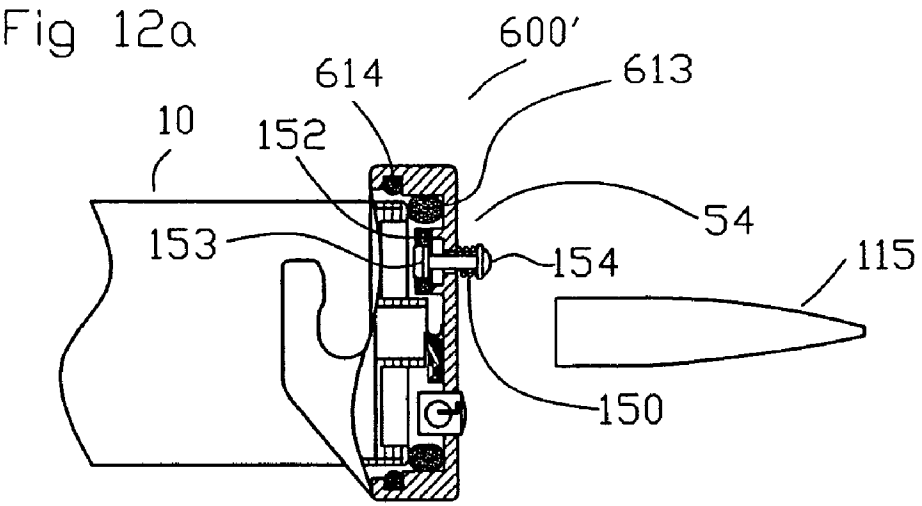

FIG. 12A is a partial sectional view of the closure cap of FIG. 3A shown in use in a trimming operation with a caulking cartridge, and a related exploded view, in partial section, of certain components of the illustrated closure cap.

Figure 12E:
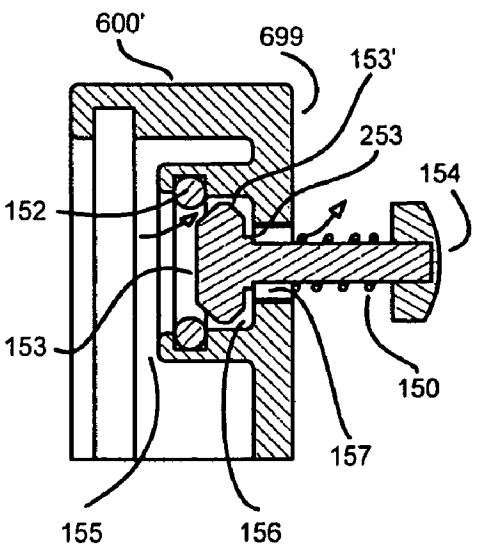
Figure 12D:
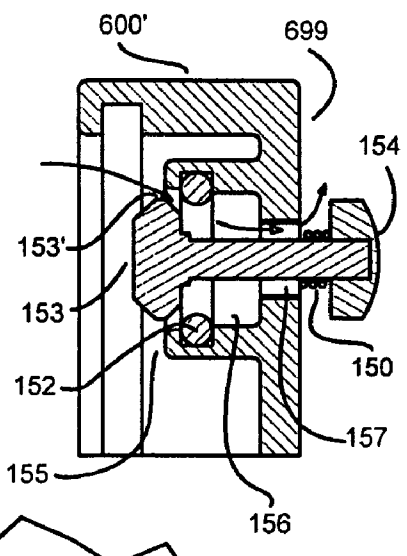
Figure 12C:
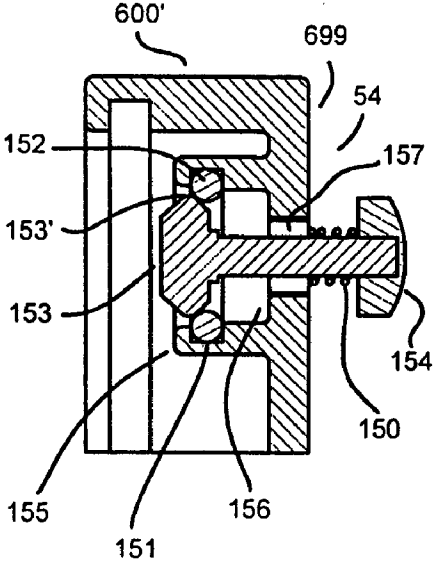
Figure 12B:
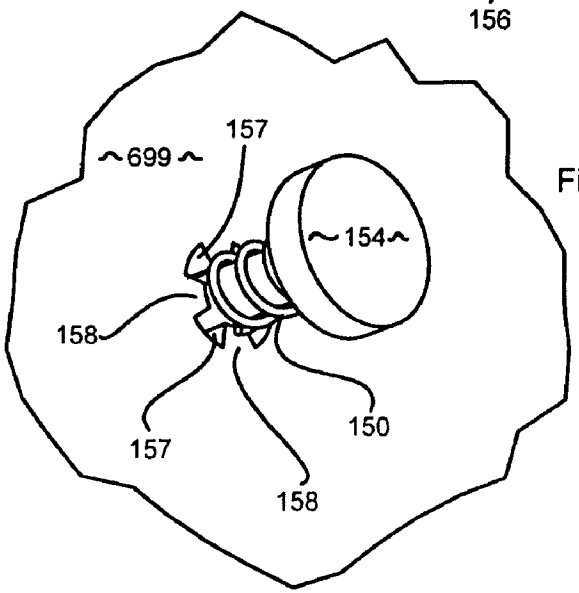

FIG. 12B is an enlarged partial side view of an embodiment of a pressure relief valve assembly shown in FIG. 12A, seated in a fully closed position.

FIG. 12C is an enlarged partial side view of the pressure relief valve assembly of FIG. 12B, shown in an operator opened position.

FIG. 12D is an enlarged partial side view of the pressure relief valve assembly of FIG. 12B, shown in a pressure activated open position.

FIG. 12E is an enlarged partial view, in perspective, of the closure cap of FIG. 3A, showing an exterior portion of the pressure relief valve assembly of FIG. 12B.

Figure 13:
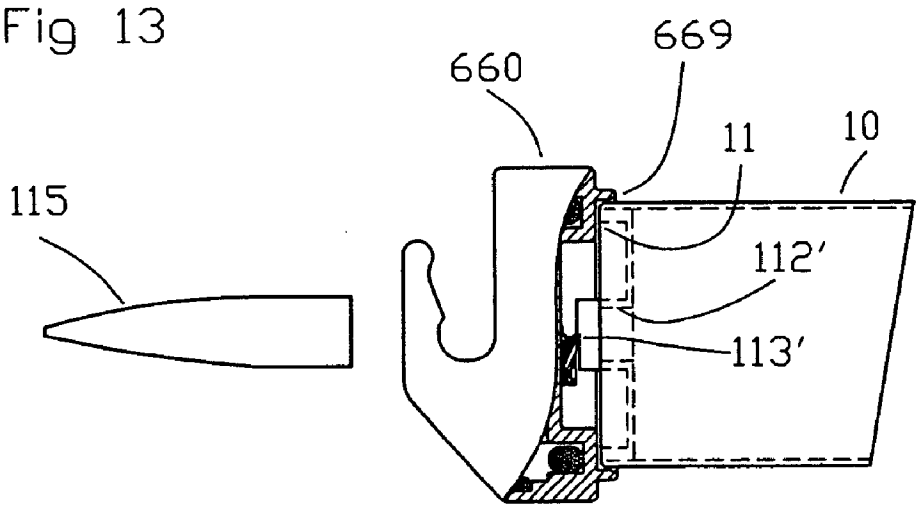

FIG. 13 is a partial sectional view of the closure cap of FIGS. 9 to 11 shown in use in a trimming operation with a caulking cartridge.

Figure 14:
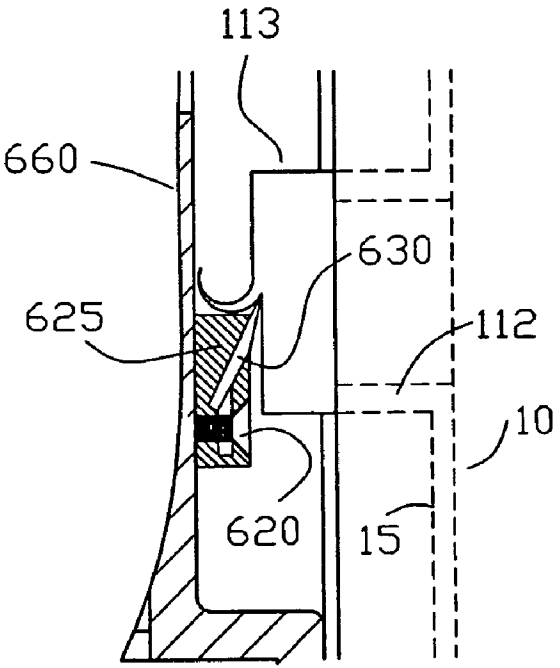

FIG. 14 is an enlarged partial sectional view of the closure cap of FIG. 13 shown in use in a trimming operation with a caulking cartridge.

FIG. 15 is a side view, in section, of a component for use with a dispensing device suitable for dispensing fluids from sausage type containers.

FIG. 16 is a side view, in section, of a sausage type container.

FIG. 17 is a side view, in section, of another component (namely, a plunger cap) for use with a dispensing device suitable for use with sausage type containers.

FIG. 17A is a side view, in section, of another embodiment of a plunger cap for use with a dispensing device suitable for use with sausage type containers.

Figure 18:
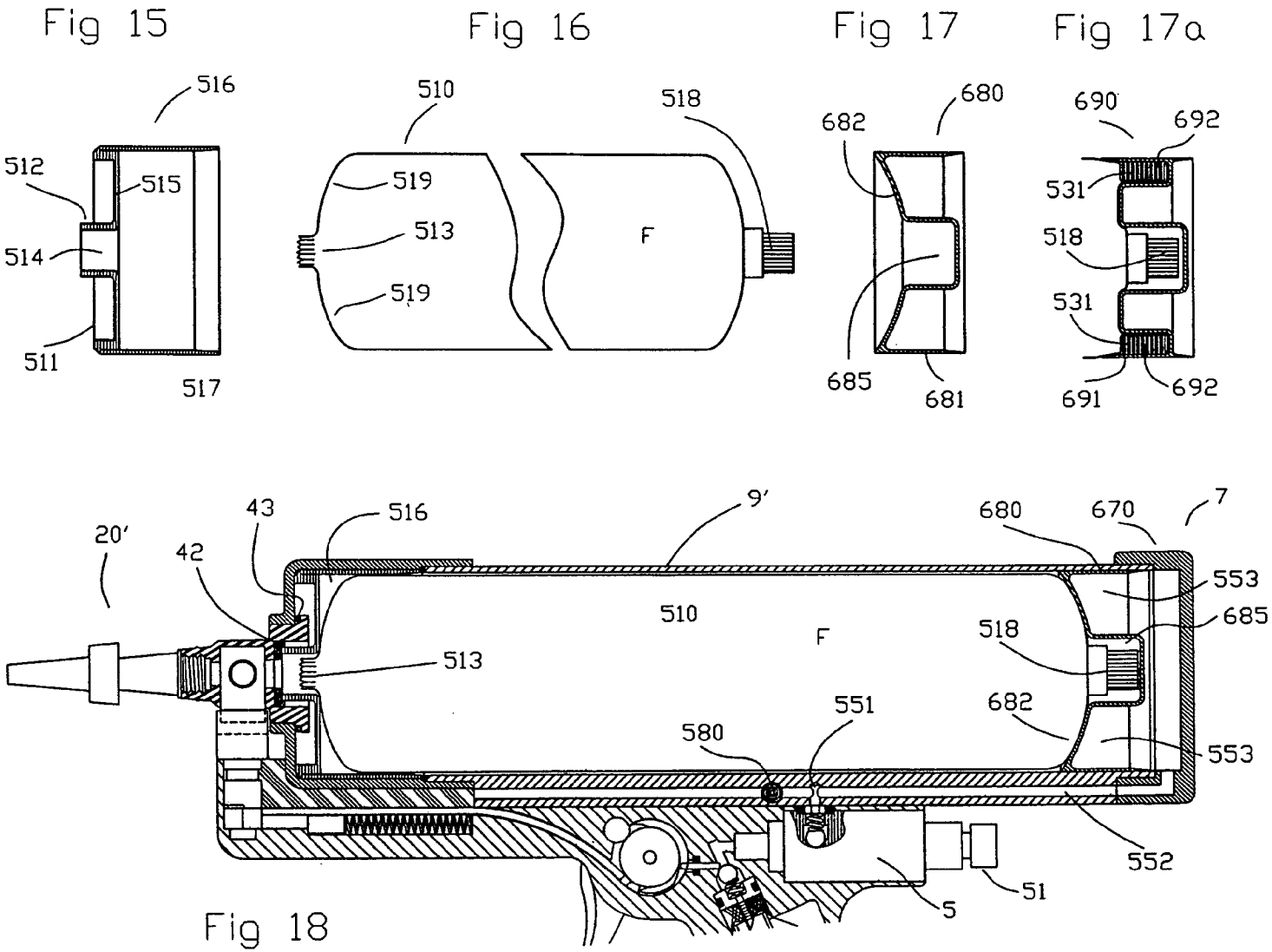

FIG. 18 is a side view, in partial section, of a seventh embodiment of the invention.

Figure 18A:
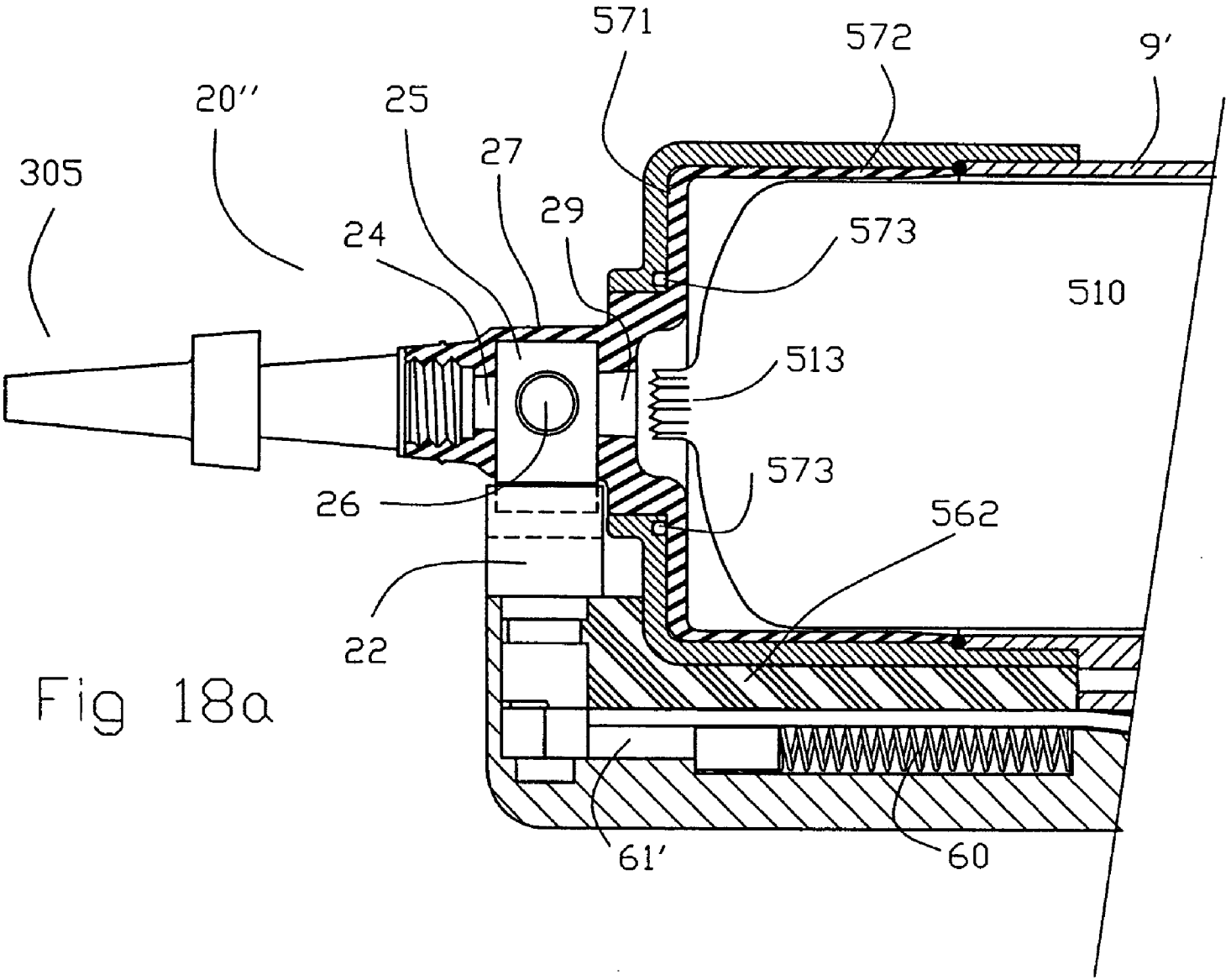

FIG. 18A is an enlarged side view, in partial section, of the dispensing end of the embodiment illustrated in FIG. 18.

Figures 19A, 19B:
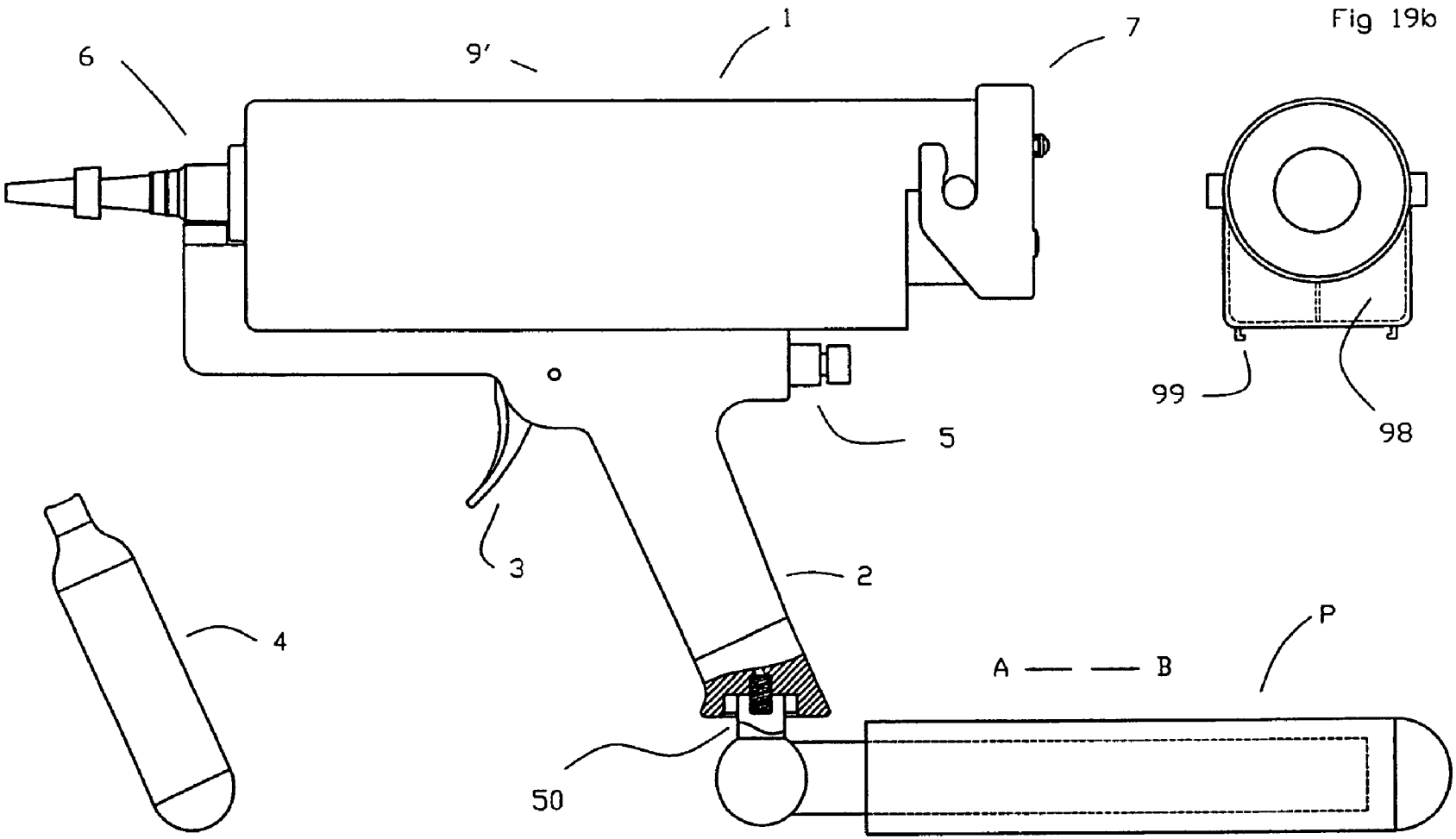

FIG. 19A is a side view of another embodiment of the invention, coupled with a detachable hand operated air pump.

FIG. 19B is an end view of a detachable housing shown in isolation from the other components of the embodiment shown in FIG. 19A.

Figure 20:
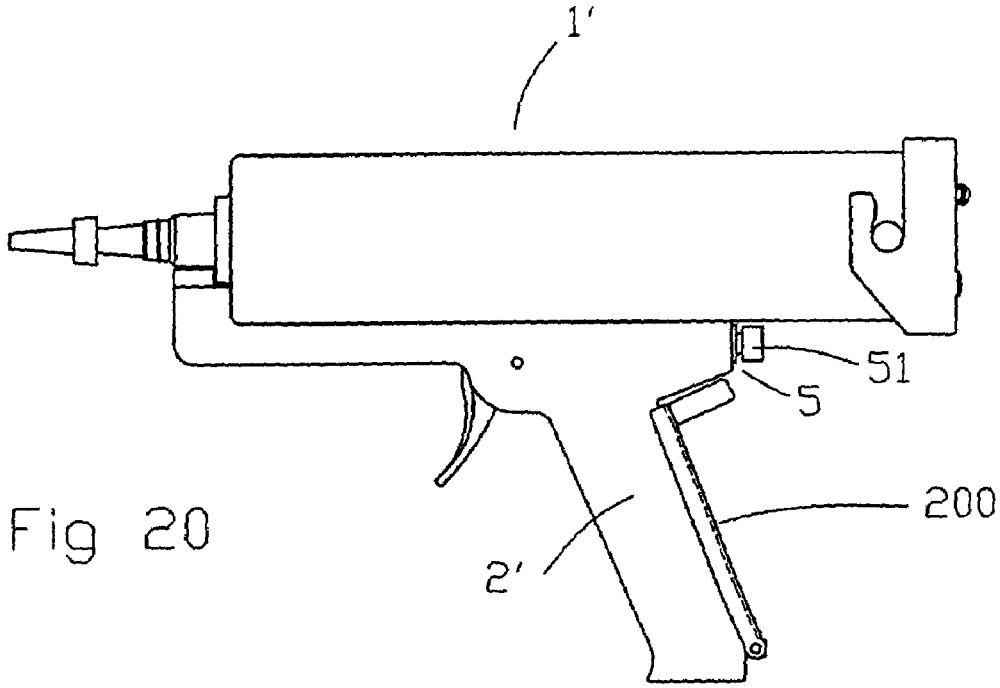

FIG. 20 is a side view of yet another embodiment of the invention, including an integral hand operated air pump.

Figure 21:
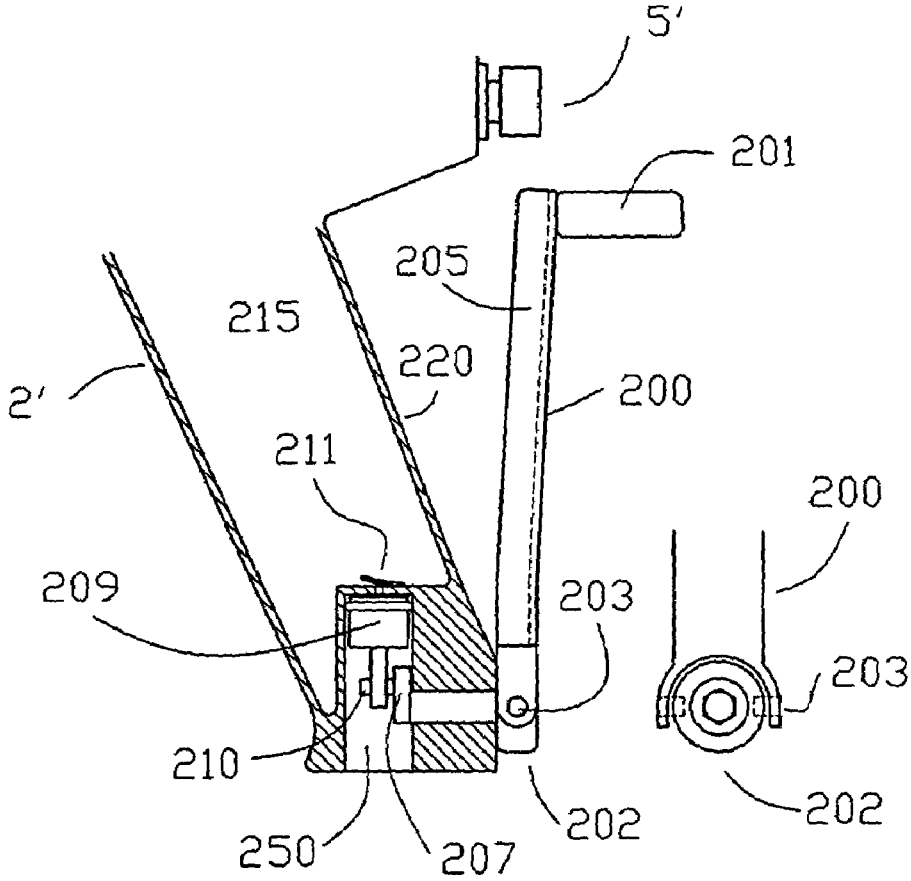

FIG. 21 is an enlarged side view, in partial section, of the hand operated air pump in position for use.

DETAILED DESCRIPTION OF CERTAIN EMBODIMENTS OF THE INVENTION

With reference to FIGS. 1A, 1B, 2A and 2B, a dispensing device 1 is shown with an air tight housing 9. The air tight housing 9 contains a tube 10 for storing a viscous, flowable material F, such as for example, caulking, sealant, mastic, or adhesive. The dispensing device 1 is provided with a handle grip 2 positioned below the housing, intermediate the dispensing end 6 and loading end 7. A control trigger 3 (used to activate the dispensing nozzle assembly 20 and permit pressurized gas to act on the material F) is pivotally mounted on the handle 2. Trigger 3 is operatively connected (by attachment at guide pin 30) to a flexible, but non-compressible, guide strap 31. The guide strap 31 is part of a guide 21 which operatively connects the movable trigger 3 to the rotatable spindle 25, at the spindle driver 28. Guide 21 is operatively connected to a rotatable guide mount 22 so that the guide mount 22 will rotate upon sliding movement of the guide 21. Guide retainer 62 is positioned between the housing 9 and the guide mount 22 to hold guide mount 22 within its operating position in the frame 110 of the dispensing device. Guide 21 travels within a longitudinal channel 34 formed within the frame 110 of the dispensing device. The guide 21 is urged by spring 17 to return to a preferred position (illustrated in this case as being the closed position), so that the trigger 3 will return to its fully extended position, and shut off flow of fluid F through the nozzle assembly.

A pressurized gas (for example $CO_2$) is stored in a replaceable cylinder 4. In alternative embodiments, the handle may define an air tight reservoir for storage of pressurized gas supplied from an exterior source, for example an air pump, pressurized air hose or other gas supply. The pressurized gas within the cylinder 4 is in fluid communication with a pressure regulator 5. The regulator 5 is provided to reduce the pressure of the gas flowing to the air tight housing 9 from an initial, relatively high storage pressure, to a lower operating pressure, typically in the range of about 20 to 90 psi. Of course, persons skilled in the art will understand that in some instances pressure regulators will not be required because of the range of pressures obtained in some designs, and in other instances, where regulators are used, the operating ranges of the regulators will vary. The regulator 5 is in fluid communication with the interior of air tight housing 9. The regulator 5 is provided with an adjustable knob 51 to allow the operator to set or adjust the gas pressure supplied from the gas cylinder 4 to the interior of the housing 9. It will be understood that some embodiments of the invention will not require a pressure regulator. In other embodiments, it may be desirable to use other types and designs of pressure regulators, including non-adjustable pressure regulators which are preset for operation within a range of acceptable operating pressures.

Figure 1A:
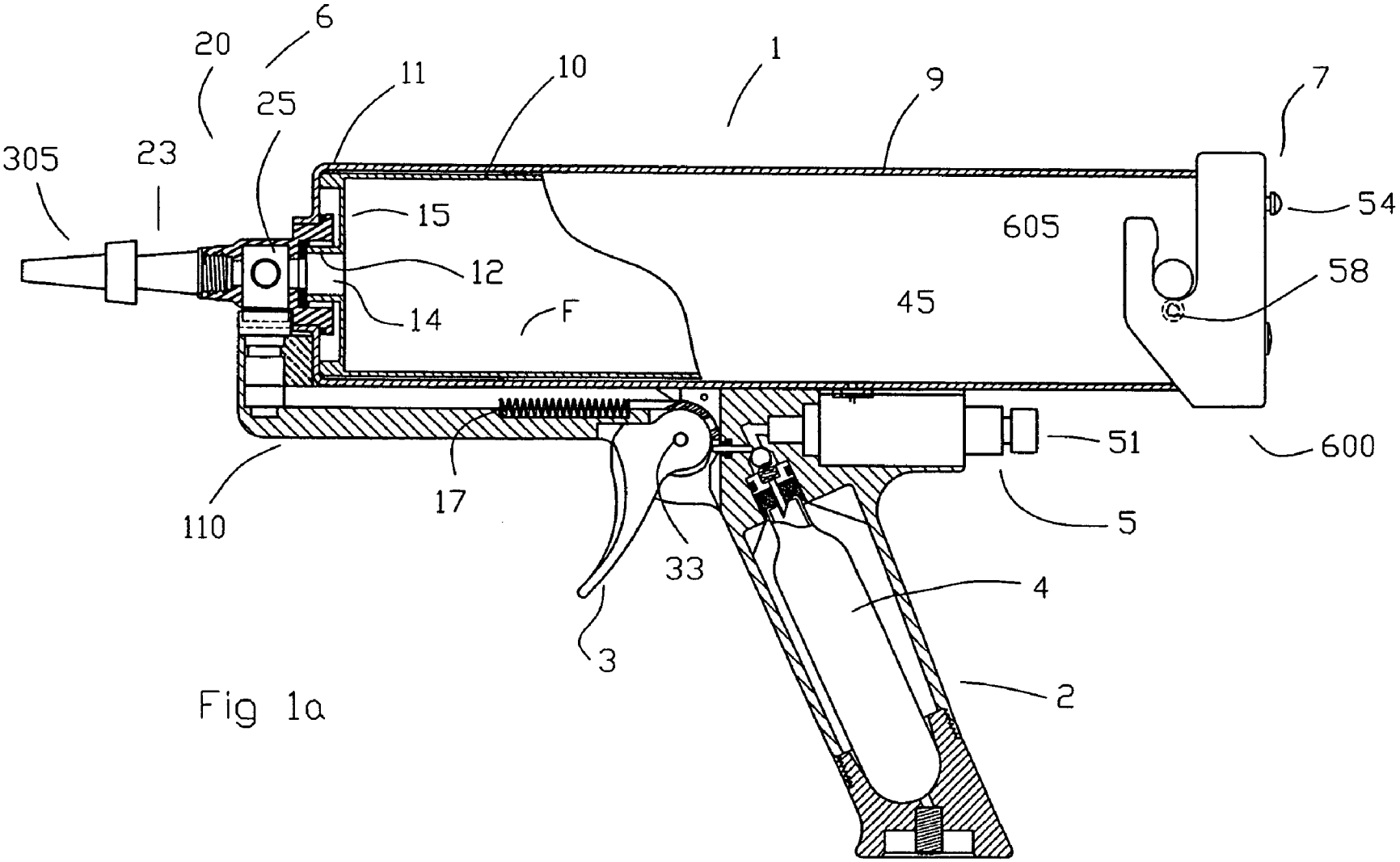
FIG. 1A is a side view, in partial section, of a first embodiment of the invention in a first operating position.
Figure 1B:
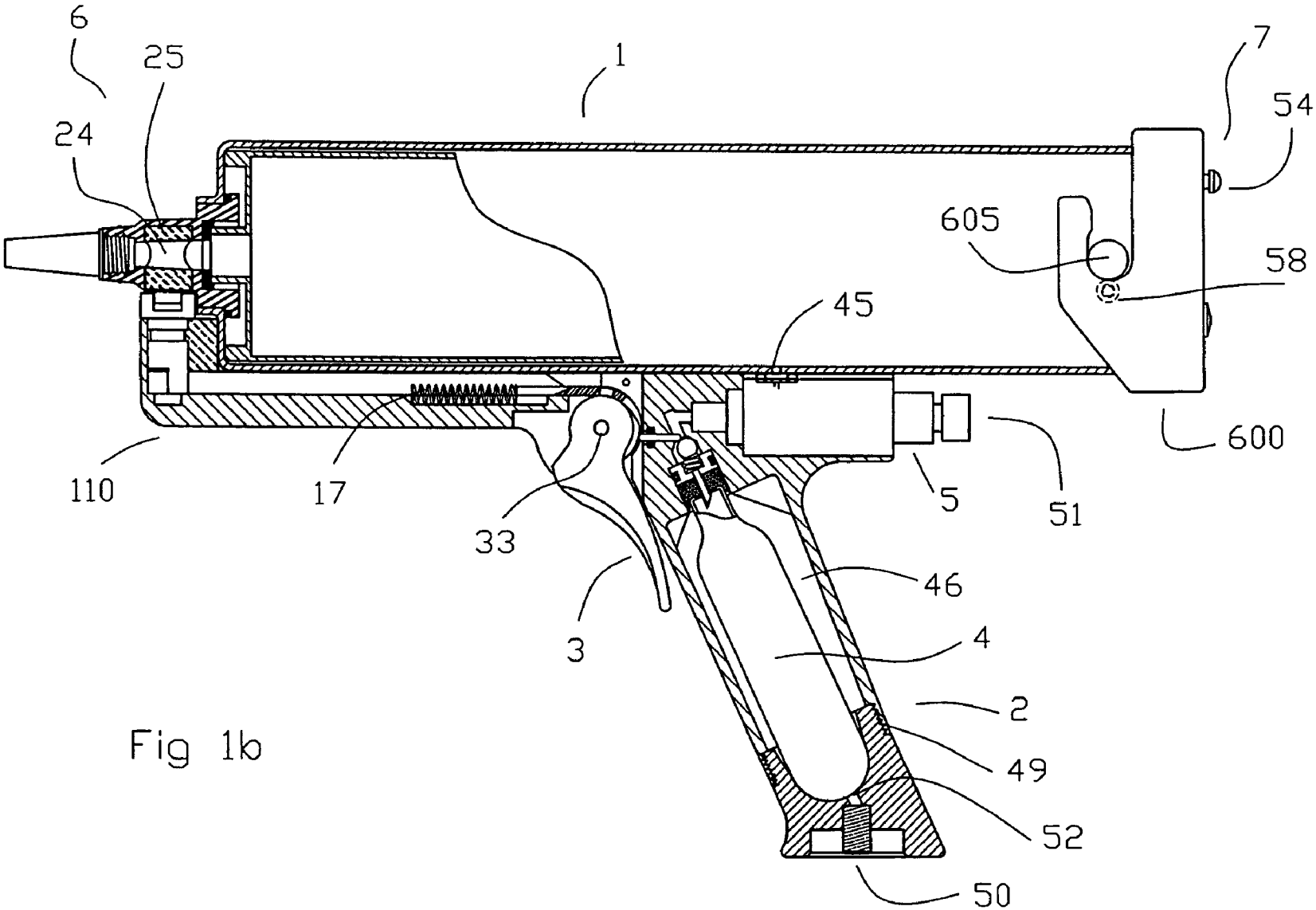
FIG. 1B is another side view, in partial section, of the first embodiment of the invention, shown in a second operating position.
Figure 2A:
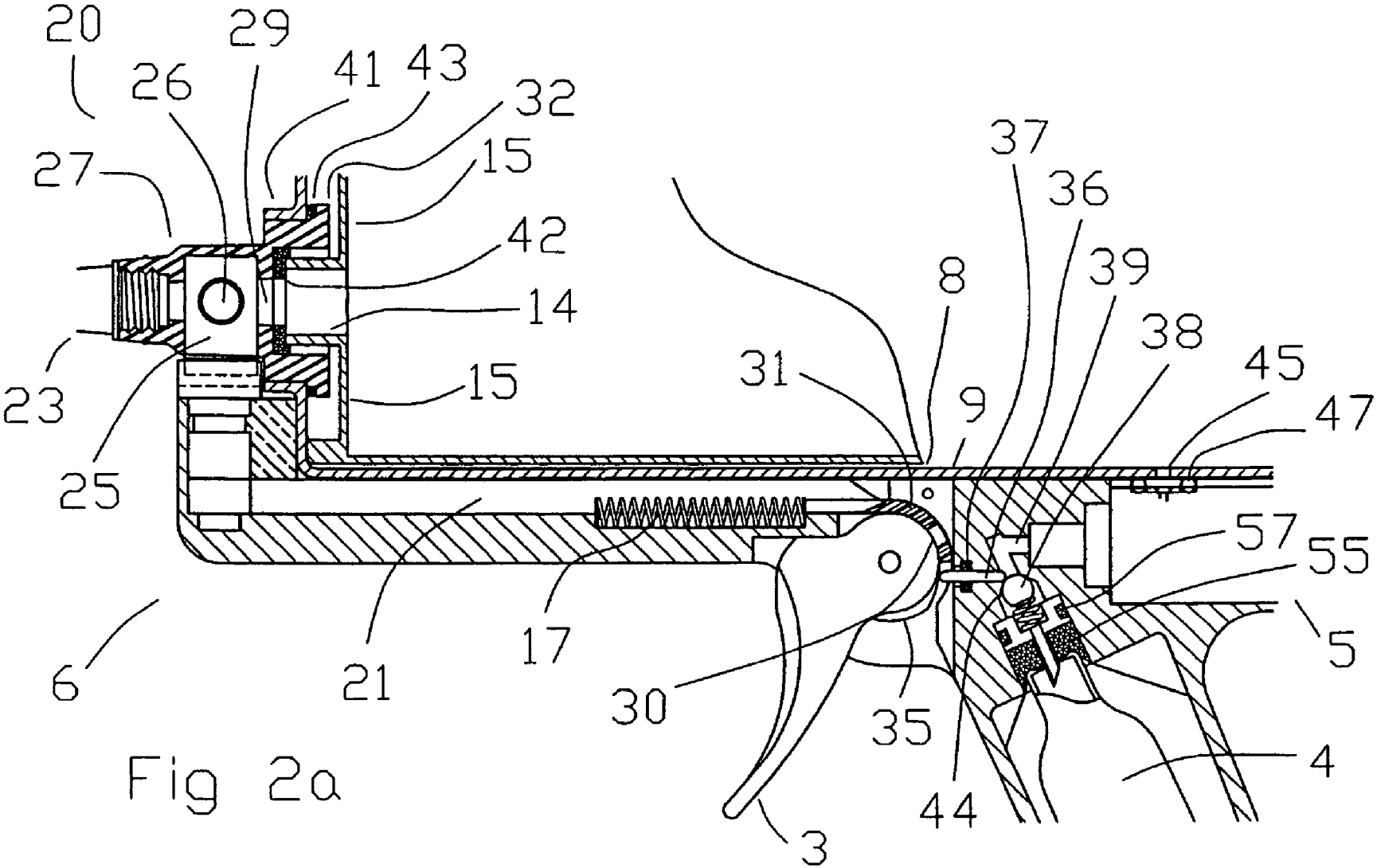
FIG. 2A is an enlarged side view of the first embodiment, in partial section, showing a portion of the dispensing end of the first embodiment, when in the first operating position.
Figure 2B:
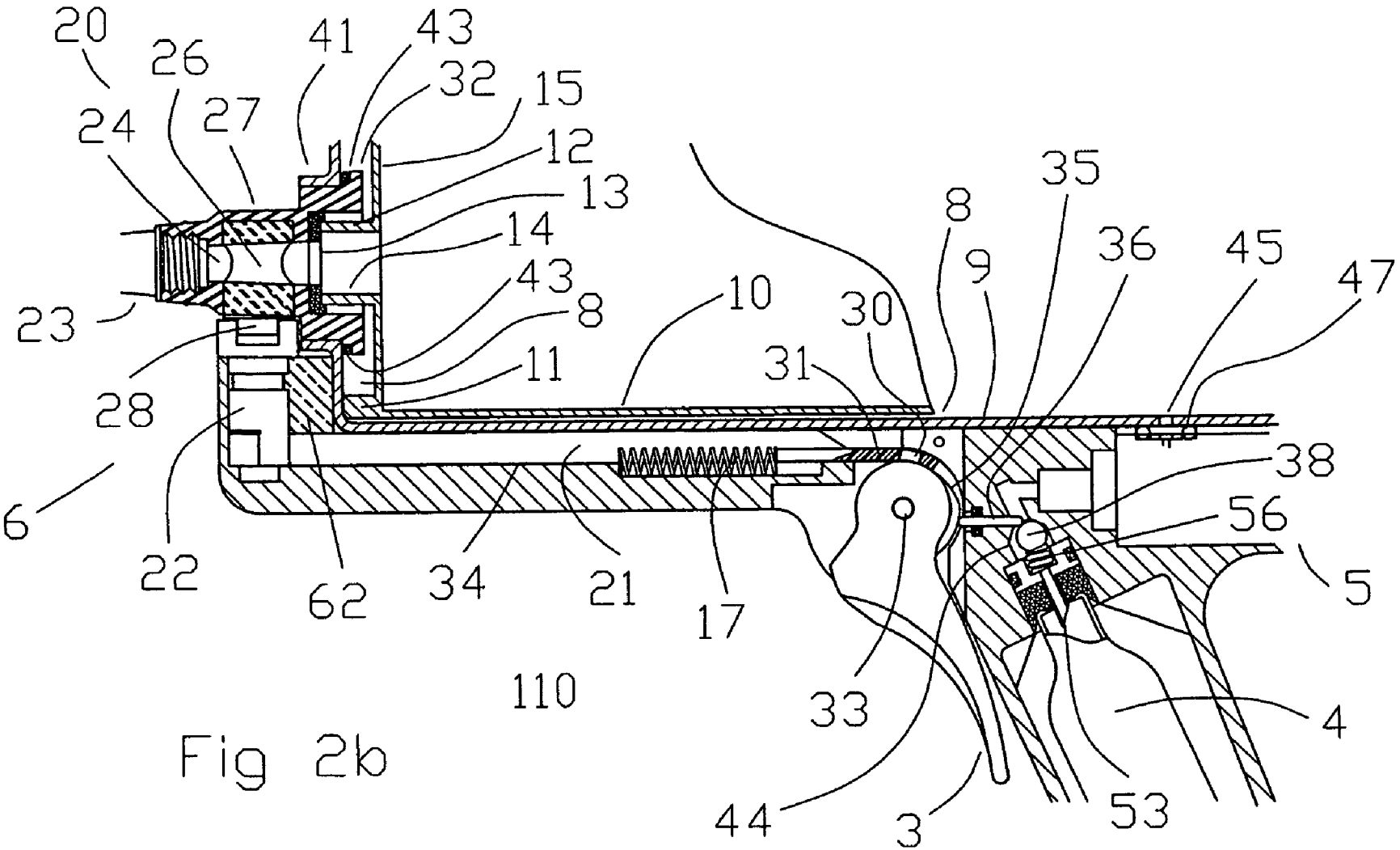
FIG. 2B is an enlarged side view of the first embodiment, in partial section, showing a portion of the dispensing end of the first embodiment, when in the second operating position.
Figure 5:
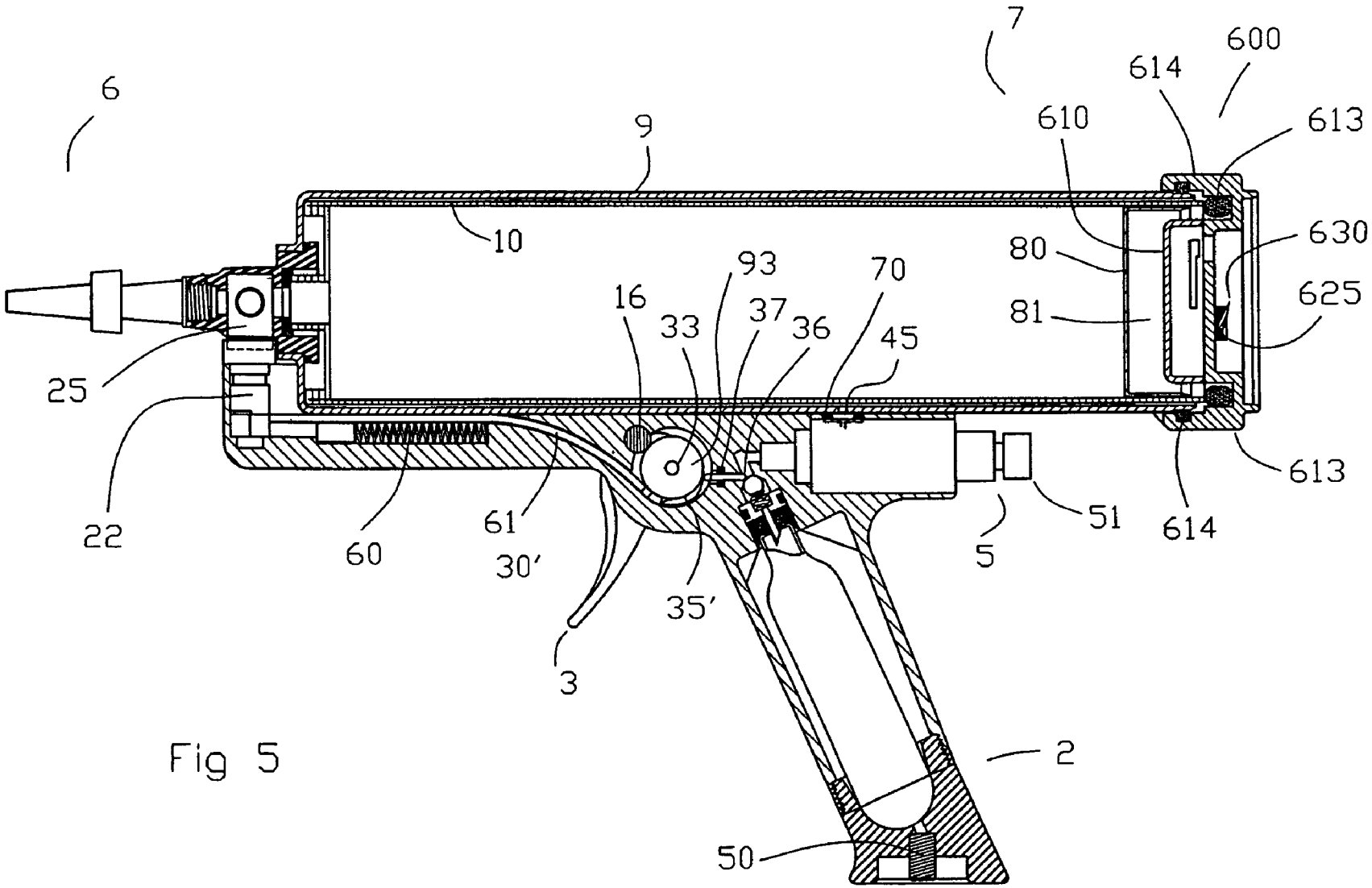
FIG. 5 is an enlarged side view, in partial section, of a third embodiment.

Gas cylinder 4 is securely nested within an air tight, pressurizable reservoir 46. When a gas cylinder is spent, a similar loaded, replacement cylinder may be introduced into the reservoir by first removing threaded handle plug 48 from the handle grip 2. After the operator has confirmed that all residual gas has been safely vented, the spent cylinder 4 is then withdrawn and the replacement cylinder is introduced into the reservoir 46. The operator then engages the threaded coupling 49 by advancing threaded handle plug 48 into the handle grip 2. As the replacement cylinder 4 is advanced into the reservoir 46, a reinforced hollow needle 53 punctures the cap of cylinder 4 to create a pressurized gas inlet into a gas valve assembly including a valve ball 38 nested within valve inlet chamber 44. Compressible seal 55 and O-ring seal 57 are positioned to inhibit leakage of gases from the cylinder 4 when it is positioned within the handle grip. Valve ball 38 is preferentially urged into a closed valve position by valve spring 56 as illustrated in FIG. 2A (corresponding also to the device as shown in the closed position in FIG. 1A). Valve ball 38 is seated within its closed position when the trigger 3 is in its closed position shown in FIG. 1A. Similarly, nozzle valve spindle 25 is in the fully closed position. However, when the trigger 3 is depressed by the operator, the trigger rotates about trigger mounting pin 33, and integral elevated cam portion 35 advances to act upon plunger 36 which is seated within plunger seal 37. As the plunger 36 advances by action of cam portion 35, plunger 36 pushes valve ball 38 from the fully closed position, thereby allowing pressurized gas to flow from the cylinder 4, through regulator inlet channel 39 and into regulator 5. The regulator 5 acts to reduce the operating pressure of the gas from a relatively high pressure of the cylinder contents, to a lower operating pressure suitable for the operating conditions of the dispensing device 1. The incoming gas, (now at a reduced pressure) travels from the pressure regulator 5, through gas feed channel 45, and into the interior of the air tight housing 9. A gasket or seal 47 is provided adjacent the feed channel 45, between the regulator 5 and the housing 9, to inhibit leakage of gas from the dispensing device. In this embodiment, the incoming pressurized gas is fed into a gap 8 between the side wall of the tube 10 and the inner surface of the housing 9. Tube 10 is preferably slide-fit within the housing 9 so that a relatively small gap 8 is formed. Typically, the gap will be in the range of about 0.005 inches to about 0.010 inches, although the gap 8 may be larger or smaller in some instances. The gap 8 surrounds the outer periphery of the tube 10, to allow the pressurized gas to surround and act upon the outer cylinder wall of the tube, and also to act upon the cartridge plunger 80 (shown in FIG. 5 and FIG. 10). The pressurized gas (which fills a gap extending along the length of the tube 10) within the air tight housing inhibits the outer cylinder wall of the tube from ballooning outwardly to fill the gap (as might otherwise occur if all pressurized gas is directed to a plunger cap at the loading end 7). When the trigger 3 is depressed, the nozzle will be opened, the pressurized gas will be allowed to act on the plunger 80, causing the plunger to advance, and thereby force viscous fluid F to flow through an opening in the nozzle tip and to apply a bead of material on the target surface.

In some embodiments, another form of operator activated control may be used, for example, a button, dial, slider, lever or other suitable element. In any case, the control element (for example, a trigger) may be provided with adjustable settings which allow the operator to identify and mark preferred control positions. For example, it may be desirable for the operator to preset one or more preferred positions corresponding to different fluid viscosities and types of viscous fluids to be dispensed. Detents may also be associated with one or more preferred positions within the range of operational movement of the control element. In some cases, the detents may be adjustable by the operator. In other instances, the detents may be predetermined.

In this embodiment, handle grip 48 is provided with an optional threaded air valve 50 seated within the base of the handle grip 48. If an operator wishes to forego the use of a replaceable cylinder 4, a conventional air pump (or other gas supply) may be coupled with the air valve 50 to pump air through air valve 50, and through gas inlet 52. The internal reservoir may be filled with pressurized air, and subsequently recharged, as needed, to operate the device.

In this instance, tube 10 is a conventional rigid container made from an extruded thermoplastic material, or spiral wound cardboard. Of course, alternate containers may be accommodated within other embodiments of the dispensing device 1. The tube 10 is loaded into the device 1 through a loading port at loading end 7, illustrated as being sealed by chamber cap 600. Cap 600 is locked in position, to form an effective seal to inhibit escape of pressurized gases from the interior of the housing 9 while the device 1 is in operation. Preferably, the device 1 is provided with safety features to seal the air tight chamber for operation within a predetermined range of operating pressures. In the illustrated embodiment, chamber cap 600 is provided with a pressure relief valve 54 which is preset to release excess gas in the event that the gases within the air tight chamber reach a pressure in excess of a preset limit. In the event of over pressurization, excess gas is vented through the pressure relief valve. The pressure relief valve may also be designed to allow an operator to selectively vent the gases from the interior of the housing 9, if desired. A second pressure relief safety valve 58 is closed when the chamber cap 600 is in the fully closed position. However, as the operator twists the chamber cap 600 toward an opening direction, safety valve 58 will vent pressurized gas from within the air tight chamber 9, before the chamber cap 600 is fully disengaged from lock pin 605 and before the cap is fully released from the housing 9.

Tube 10 comprises an outwardly projecting shoulder 11 which forms a rim about front wall 15 of tube 10. A stem 12 projects outwardly from front wall 15. The stem 12 terminates at end 13, and defines an outlet bore 14 defining a fluid communication path with fluid contents F in tube 10. Nozzle assembly 20 is configured to securely receive stem 12 and define an enclosed fluid path from the interior of the tube 10 to the interior of the nozzle assembly 20. The base of the nozzle assembly 20 includes mounting flange 32 which projects radially, outwardly from the longitudinal axis of the nozzle assembly 20. The base of the nozzle assembly 20 is sealed against O-ring 43 and the front 41 of the housing 9. When the nozzle assembly 20 is securely positioned relative to stem 12 of tube 10, stem end 13 will abut against nozzle seal 42 positioned within the nozzle base. Similarly, it is preferred that the mounting flange 32 abut against front wall 15 to further re-enforce front wall 15 against excessive deflection or movement when the fluid contents F are pressurized. The base of nozzle assembly 20 defines a spindle housing 27. Spindle 25 is retained with spindle housing 27 and is permitted to rotate so that the through bore, which defines spindle channel 26, may be moved between open and closed positions. In the closed position, spindle channel 26 is oriented transversely to the internal, tapered cavity 24 extending along the longitudinal axis of the nozzle assembly 20. In the closed position, spindle 25 prevents fluid communication between tapered cavity 24 and bore 14 of tube 10. Entrance cavity 29 defines a closable opening to a fluid flow path along the longitudinal axis of the nozzle assembly 20. Rotatable spindle 25 is moved between open and closed positions via spindle driver 28. Spindle driver 28 may be connected to an actuator assembly in a caulking gun or other suitable dispensing device. Upon rotation of spindle 25 about its rotational axis, spindle channel 26 may be oriented in a plurality of partially, offset positions to impart variable flow rates of fluid F travelling between the interior chamber of tube 10 and nozzle tip 23 of nozzle assembly 20. In a preferred embodiment, the tapered nozzle assembly 20 is provided to the user with a closed end including a removable reclosure cap 305 at the dispensing end 6 of dispensing device, shown positioned over nozzle tip 23 in FIG. 1A. In many instances, the nozzle assembly, and in particular the nozzle tip 23 may be made of molded thermoplastic material. Pre-marked cut lines (not shown) may be provided to suggest appropriate points at which the closed end may be cut away from nozzle assembly 20, to form a dispensing outlet on nozzle tip 23. As more of the closed end is cut away from the tapered nozzle tip 23, a larger dispensing outlet is formed, to permit a wider bead of dispensed material to flow through tapered cavity 24.

Figure 4:
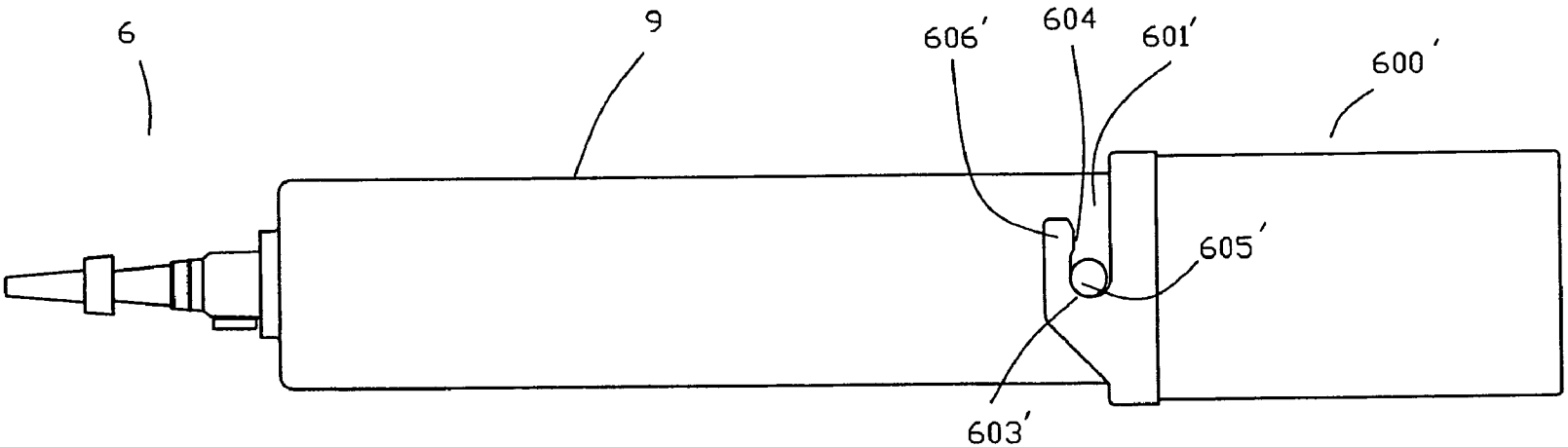
FIG. 4 is a partial side view of a second embodiment of the present invention.

With reference to FIGS. 3A, 3B, and 4, two alternative chamber caps 600 and 600' are illustrated. A chamber cap 600 is provided to secure a standard sized tube or cartridge (for example, a caulking cartridge) within the housing 9. In FIG. 3A, the chamber cap 600 is shown in the fully sealed position, so that lock pin 605 is fully engaged within channel 601 defined between retainer arm 606 and the main body of cap 600. Safety valve 58 is aligned to seal chamber opening 607, shown in FIG. 3B. An O-ring 614 fitted within rim 611 provides a gas tight seal between the cap 600 and the housing 9, to inhibit leakage of pressurized gas from the device 1. As the chamber cap 600 is displaced away from channel end 603 to a partially opened position, and safety valve 58 is displaced from opening 607, to allow any pressurized gas to vent to atmosphere, before the cap 600 is fully disengaged from the housing. A detent 604 is provided adjacent the end of arm 606, to encourage the operator to pause while opening the chamber cap 600, so that the pressurized gas is completely exhausted before the cap is fully disengaged. FIG. 4 illustrates an extended mounting cap 600' provided to enclose a cartridge, tube or other container of greater length. For example, some sealants, and other viscous materials are packaged in substantially elongated tubes and containers that will not fit within standard housings. An elongated chamber cap 600' may be provided to extend the effective length (and interior volume) of the air tight housing 9. The cap 600' is secured to housing 9 by engaging lock pin 605' in channel 601', defined between retainer arm 606' and the main body of the cap 600'. When the cap is fully engaged with the housing 9, the lock pin 605 abuts against channel end 603'. A detent 604 is also provided on retainer arm 606' to encourage the operator to pause before fully disengaging the cap from the housing. Although a safety valve is not shown in FIG. 4, a safety valve or other venting arrangement is preferred to ensure that any remaining gases are fully exhausted before the cap is fully disengaged.

With reference to FIG. 5, FIG. 6, and FIGS. 7A to 7F, a dispensing device is illustrated with an alternative flexible guide strap assembly 61. One flexible end portion of strap assembly 61 is secured at guide pin 30' to trigger spool 93. Trigger lock 16 is used to selectively lock the trigger 3 to prevent accidental operation of the device. When the trigger is unlocked, and depressed by the operator, the elevated cam portion 35' presses against plunger 36 to activate the ball valve assembly. Pressurized gas is allowed to travel through the pressure regulator, reducing the pressure of the gas traveling through gas feed channel 45, and into chamber space 81, to act on the outer surface of the cartridge plunger 80. The loading end 7 of the dispensing device is sealed by chamber cap 600. Chamber cap 600 is defined in part by an internal wall 610. Compressible rubber springs 613 are placed within an inner channel, along an inner wall of the chamber cap 600'. When the chamber cap 600' is fully engaged with the housing 9, the compressible rubber springs 613 abut against the adjacent end of the tube 10, to urge the tube 10 toward the dispensing end 6, thereby forming a tight seal between stem 12 (on tube 10) and O-ring 42. Seal 614 provides a gas tight barrier against leakage of gas from the interior of the device. At the dispensing end 6 of the device, guide assembly 61, and consequently interconnected nozzle spindle 25 and the ball valve assembly, are urged by spring 60 to return to a preferred position, which in this instance is the closed position. In the preferred embodiment, the flexible end portion 61' of the guide strap assembly is wound about circular spool 90 provided on the guide mount 22 when the trigger is released, and the nozzle is closed as shown in FIG. 7A. However, as shown in FIG. 7B, when the trigger is depressed and the nozzle is opened, the opposite end of the guide strap assembly 61 is wound about circular trigger spool 93.

Persons skilled in the art will appreciate that there may be instances in which it is desirable for operators to have a greater degree of control available for operation of the nozzle. Cams of various relative shapes and sizes may be provided to impart different operating characteristics. For example, it may be desirable to provide a greater degree of control or sensitivity as the nozzle approaches a fully opened position as the spindle channel 26 approaches alignment with tapered cavity 24. In other instances, it may be desirable to impart different operating characteristics at other operating positions. By way of example, FIGS. 7C and 7D illustrate an alternative embodiment of the guide strap assembly in which the guide mount 22' is fitted with cam 92 to impart a nonlinear opening movement for the nozzle valve relative to the movement of the trigger 3. In this embodiment, the opposite end of the guide strap 61 is attached to a circular trigger spool (not shown). In FIGS. 7E and 7F, yet another guide strap assembly is illustrated in which the opposite end of the guide strap 61 is connected at guide pin 30' to a cammed spool portion 94 provided on the trigger 3 whereas strap portion 61' is secured to a circular spool 90. Of course, other features may be used to vary the rate of opening the nozzle valve, or if desired, to vary the operating gas pressure used to urge the cartridge plunger 80 against fluid F.

FIG. 8 is an exploded view of the main components of the ball valve assembly in the preferred embodiment, shown apart from the gas cylinder 4 and handle plug 48. When installed, air valve 50 is seated within valve seat 59. Threaded portion 48' of the handle plug is used to secure the plug 48 to the main portion of the handle 2.

FIGS. 10 and 11 illustrate enlarged views of the preferred chamber cap 600. Internal pressure indicator 641 displays the pressure readings via an indicator needle 640 visible to the operator. The pressure indicator may be calibrated so that the needle may be used to display readings along a graduated scale clearly marked for viewing by the operator. The exterior of the chamber cap 600 is provided with knife 630 secured by mounting screw 620 to knife base 625.

FIG. 9 illustrates a modified chamber cap 660 with a ramped closure portion 662 on retainer arm 661. The chamber cap 660 is shown in the fully sealed position, in which the lock pin 605 is fully seated within recess 666, corresponding to a detent. It will be understood that the rubber springs 613 are compressible, and that the operator will be able to engage the lock pin 605 with the end of the retainer arm 661 using a moderate force. However, the operator will face added resistance as the operator must further compress the rubber springs 613, thereby improving the quality of the seal at the front end of the tube, as the pin is advanced along ramped portion 662 toward the fully sealed position at detent 666.

In some instances, a caulking tube 10 or other container may come with a pre-attached, elongated nozzle made of a thermoplastic material or other material which may be cut and trimmed. For example, many cartridges used for sealants, including, caulking, adhesives, and other dispensable, viscous materials are provided with such pre-attached, hollow nozzles. In FIGS. 12A and 13, such a cartridge, for example, tube 10 is originally provided with an elongated nozzle piece 115. The nozzle 115 may be cut by the user to an intermediate length represented by pre-cut end 113. The remaining, hollow stem portion 112 may be trimmed to a pre-selected, desired length by rotational engagement with a knife 630 securely mounted within a modified chamber cap 600' or 660. In the illustrated embodiments, chamber caps 600', 660 include a knife 630 secured with a mounting screw 620, to a knife base 625. In some embodiments, it will be particularly important to ensure that the stem on the tube is cut to a required length, to ensure a suitable and secure fluid connection with the nozzle assembly. Although the foregoing examples describe a knife mounted within a chamber cap, similar pre-set cutting and trimming features may be included within another component of the dispensing device (not shown) or as a separate tool (not shown) which may be included in a nozzle assembly installation kit.

FIGS. 12A, 13 and 14 illustrate a trimming step involving the use of the knife 630 to trim away excess material from a remaining stem on the tube 10. A cut away portion 115 of the preattached thermoplastic nozzle is discarded. In the chamber cap 660 illustrated in FIGS. 13 and 14, inwardly projecting rimmed ledge 669 is provided on the exterior wall of the chamber cap 660 so that, when the rimmed ledge 669 is engaged with the shoulder 11 of the tube 10, the precut stem is properly positioned and centered relative to the knife 630. Precut stem end 113 is positioned in contact with the edge of knife 630 so that the stem end 113 will be trimmed as the tube 10 is pressed against, and rotated relative to, the knife 630. The trimming step is completed leaving a finished stem 112 of a predetermined length so that the overall cartridge dimensions are suitable for loading within the housing 9 of the dispensing device. On the other hand, the chamber cap 600' illustrated in FIG. 12A lacks an inwardly projecting ledge 669 and the knife is hidden within the interior of the housing when the cap is in place to seal the housing. For example, it may be desirable to hide the knife and its cutting edge to avoid accidental injuries or damage to the knife blade. In this embodiment, chamber cap 600' has a knife 630 fixed on the interior of the end wall so that the shoulder 11 of the tube 10 abuts against rubber springs 613 when the tube is rotated to trim away excess material from the stem 112.

FIG. 12A also shows an example of a dual-function pressure relief valve assembly 54. The pressure relief valve assembly 54 is also shown in FIGS. 12B, 12C, 12D, and 12E. The pressure relief valve assembly includes a relief valve defining an elongated body with inner flange 153 and opposing outer flange 154. Relief valve 54 is slidefit within a multi-channeled port defined within the end wall 699 of the cap 600'. A partially compressed spring 150 is snugly fit within a first space defined between the outer surface of the end wall 699 and outer flange 154. The spring 150 urges the relief valve to stay within the fully closed position (also shown in FIG. 12C). Valve seal 152 is seated within a recess 151 defined by raised collar 155. When the relief valve is in the fully closed position, the inner flange 153 rests tightly against valve seal 152 so that, when the dispensing device is in normal operation, within acceptable pressure limits, the relief valve 54 is seated in a fully closed, and sealed position. However, as shown in FIG. 12E, if the internal gas pressure in the housing exceeds a preset limit, the relief valve 54 is displaced outwardly. This outward displacement of relief valve 54 creates a vented opening (between seal 152 and flange 153, around flange lip 153', through basin 156, and out through a plurality of channels 157 defined between opposing radially projecting retaining fingers 158) to allow excess gas to escape, thereby reducing the internal gas pressure. Valve seal 152 may be constructed of suitable material to be deformable, with a memory, so that the valve seal may be reused and the inner flange 153 may be reseated against the valve seal 152 in the fully closed, and sealed position, after the over pressurization has been corrected. The relief valve 54 is also configured to allow the operator to press outer flange 154 inwardly (as shown in FIG. 12D) to compress spring 150, and in turn unseat inner flange 153 from the inner valve seal 152, to exhaust pressurized gas from the interior of the housing. The operator may use relief valve 54 to completely exhaust the pressurized gas from the chamber before removing the chamber cap 600' from the housing.

The dispensing device of the invention is also useful for dispensing viscous fluids from prepackaged sausage type containers. FIGS. 15, 16, 17, 17A, 18, and 18A illustrate embodiments of the invention adapted to dispense fluid from sausage type containers 510. FIGS. 18 and 18A show a modified housing 9' locked into a sealed, air tight position, in alignment with the nozzle assembly and with the gas supply from the pressure regulator 5. Unlike the embodiments of the housing 9 shown in FIGS. 1A, 1B, 2A, and 2B which provided an equalized pressure surrounding the side walls of the tube 10 and slidable plunger within the tube 10, the housing 9' is modified to direct the operative pressurized gas stream toward the loading end of the device, into the gas chamber 553, to act against plunger cap 680. As shown in this example, pressure reduced gas exits regulator valve 551, into gas supply line 552 which is directed toward the chamber 553 formed between the plunger cap 680 and chamber cap 670. Sealed, crimped end 518 of sausage type container 510 is positioned against concave end wall 682 of plunger cap 680. The crimped seal at end 518 nests within recess 685 within the plunger cap 680. Side wall 681 of the plunger cap 680 fits snugly within the housing 9' to form a gas tight seal while allowing the plunger cap to slide within the housing toward dispensing end 6 during operation. As the dispensing device is operated and the plunger 680 advances along the longitudinal axis of the housing toward the dispensing end 6, and more fluid is expelled from container 510, the emptied portion of the sausage liner tends to fold and gather inwardly, toward the center of the concave end wall 685. An alternative embodiment of the plunger cap 690 is shown (in FIG. 17A) having side wall 691 forming annular pocket 692 to receive the empty, folded liner 531 of the sausage type container 510. Crimped end 518 of the sausage type container nests within a recess 695.

With referenced to the exploded views of FIGS. 15, 16 and 17 and the assembled view of FIG. 18, the opened end 513 of the sausage type container 510 is loaded to snugly fit within a front cap 516, positioned at the dispensing end 6, adjacent the nozzle assembly 20'. Front cap 516 is one example of a funnel which may be used to channel viscous fluid F from the open end 513 of the sausage type container 510 toward the nozzle. Open end 513 fits within bore 514 of the front cap 516, with shoulder portions 519 of the sausage type container abutting against front wall 515 of front cap 516. The front cap 516 is formed with a stem 512 and shoulder 511 of predetermined, suitable lengths to properly fit within the housing, in sealed engagement, when the sausage type container is loaded and sealed into the housing 9' for operation. O-ring 43 and nozzle seal 42 are fitted against the base of the nozzle assembly 20' to inhibit escape of gas and viscous material from the interior of the housing 9'. Outer wall 517 of front cap 516 tightly fits against the interior surface of the housing 9'. A gas tight plug 580 is shown blocking a longitudinal bore extending along the length of an extruded embodiment of the housing 9. The plug 580 defines a terminal end to gas supply line 552, so that pressurized gas is channeled to the interior of the housing, via a co-aligned segment of the gas supply line extending within chamber cap 670, to exert pressure against the plunger 680.

The invention also includes a kit for adapting sausage type containers for use in gas operated dispensing devices. By way of example, one embodiment of the kit comprises the front cap 516, the sausage type container 510, and the plunger 680 shown in FIGS. 15, 16 and 17. In another embodiment, the kit comprises the front cap 516, the sausage type container 510 and the plunger 690 shown in FIGS. 15, 16 and 17A. In one aspect, the kit is intended for use with a gas powered dispensing device (which, by way of example, may be a caulking gun). Typically, the dispensing device will have a sealable tubular housing that will be in fluid communication with a source of pressurized gas. The dispensing device will also have a nozzle assembly for dispensing a viscous fluid from within the tubular housing. The kit will include a collapsible tubular container, for example, a sausage type container having flexible outer walls, filled with a viscous fluid. The collapsible tubular container defines a first end with a sealed opening and a closed end opposite the first end. A funnel is first inserted into the tubular housing. When the first end is opened and the collapsible tubular container is inserted into the tubular housing, the funnel is positioned intermediate the nozzle assembly and the opened, first end of the sausage type container. When inserted, the funnel provides a sealable communication path between the first end and the nozzle assembly. The kit also includes a plunger that is inserted into the housing, adjacent the closed end of the sausage, so that plunger slides within the tubular housing. When inserted, the plunger forms a movable seal between the source of pressurized gas and the collapsible tubular container. In other embodiments, the plunger defines a cap with a recess. The recess is configured to receive a crimped seal at the closed end of the sausage type container. This recess may also receive a folded portion of the outer wall of the sausage type container when some of the viscous fluid is expressed from within the sausage type container. In another embodiment, the cap may have a first recess to receive the crimped seal and a second recess to receive the folded portion of the outer wall of the sausage type container. Other embodiments are also possible.

With reference to FIG. 18A, an alternative nozzle assembly 20" is shown having an integral front cap portion defined by a shoulder 571 extending to side wall 572. In this embodiment, the nozzle assembly and front cap are formed as one unitary work piece. A modified guide retainer 562 secures guide mount 22 and a portion of the guide strap assembly within the frame of the dispensing device. O-ring 573 forms a gas tight seal to prevent escape of gas in the space between the front end wall of the housing and shoulder 571. Sausage type container 510 is loaded within housing 9', with open end 513 adjacent entrance cavity 29 of the nozzle assembly 20". When the trigger of the dispensing device is depressed (with the end cap 305 removed), the spindle 25 is rotated within spindle housing 27, as the strap 61 is moved by the trigger action. As the strap 61 is pulled, the spindle opening 26 is aligned with the tapered channel 24, and the plunger cap is urged toward the dispensing end 6 to expel fluid F from the sausage container 510.

FIG. 19A shows an alternative arrangement for storing pressurized gas within the storage reservoir in the handle grip 2 of the dispensing device. $CO_2$ cylinder 4 is removed from the internal reservoir. A hand operated air pump P is coupled with air valve 50 so that pumping action of the pump handle (indicated by arrows A, B) will charge the reservoir with air. The pump may be used to recharge the reservoir with pressurized air as needed to dispense fluids from the device. FIG. 19B shows an end view of a removable housing 9' which includes an additional storage compartment 98 for storage of compressed air received from the hand operated pump P. In this embodiment, the removable housing 9' is secured to the base of dispensing device 1 along tracks 99 which engage with corresponding recesses defined within the base (not shown). Of course, other features may be used to removably secure the housing to the base of the dispensing device 1. It will also be appreciated that the reservoir may have multiple compartments for storage of pressurized gas. One of the storage compartments may be located within the handle grip. Each storage compartment may be provided with separate valves to selectively control flow of pressurized gas into and out of the storage compartments. In some embodiments, it may be desirable to have a reservoir for compressed air within the housing and a separate reservoir for receiving a $CO_2$ cylinder within the handle grip. Other configurations and variations are also possible.

FIG. 20 and FIG. 21 show an alternative hand operated air pump arrangement in which a foldable pump lever 200 engages back wall 220 of handle grip 2'. A portion of back wall 220 fits within a receiving channel 205 of corresponding dimensions. Pump handle 201 spins freely relative to pump lever 200, for added comfort when the operator turns the lever 200. Pump lever 200 pivots relative to hub 202 about pivot pins 203. Hub 202 is coupled to rotatable pump stem 207 fitted with offset coupling pin 210. Coupling pin 210 is rotatably connected to pump piston 209 which travels along a defined stroke path within cylindrical bore 250. As air is compressed by upward movement of the piston 209 within bore 250, one way valve 211 is urged open and additional air is introduced into internal air reservoir 215.

In one aspect, the nozzle assembly is preferably made of a rigid, inexpensive material such as thermoplastic. In other instances, it may be desirable to include components made from different materials. By way of example, in certain instances, it may be desirable to inhibit sticking or seizure of the valve spindle within the spindle housing. As an example, the valve spindle may be made of Teflon™ or other material selected to allow free rotational movement of the spindle within the spindle housing. By way of example, Teflon™ or other materials may be selected for their compatibility with other materials of construction and dispensable fluids. For example, certain thermoplastics are less prone to sticking or seizure when used in connection with certain types of dispensable fluids such as adhesives. In other instances, one or more components may be made from metal, alloys, or other resilient, corrosion-resistant, rigid materials. In many instances, certain embodiments of the nozzle assembly will be made from inexpensive, thermoplastic materials having suitable performance characteristics to satisfy the needs of the particular applications in which they will be used. Often, other nozzle assemblies made of inexpensive thermoplastic materials will be sufficiently inexpensive permitting users to throw away the nozzle assemblies after a single use, or if an assembly is damaged or rendered unusable due to clogging or other obstructions.

In other embodiments, the nozzle assembly may be designed for removable engagement with one or more caulking tubes or other containers for flowable, viscous materials. That is, certain embodiments of the nozzle assembly may be designed for reuse for extended periods of time, and with different types of dispensing containers.

In certain embodiments, the nozzle assembly will comprise a unitary body cast, molded or otherwise formed from a single work piece. The nozzle body may include a nozzle tip, a housing for a movable valve component such as a spindle or other gate and a mounting base. In other embodiments, the nozzle assembly may have a nozzle body made up of two or more interconnecting parts or components. For example, a modified nozzle body may have a mounting base designed to secure the base to a mounting stem on a caulking tube or other container. The mounting base will define a mounting end with which it will be secured to the mounting stem of the caulking tube. At the opposite end of the mounting base, an interchangeable nozzle tip may be secured. The interchangeable nozzle tip may also be provided with a corresponding cap to reclose the opening at the dispensing end of the nozzle tip. Of course, other multiple component variations of the nozzle assembly will also be possible. For example, the interchangeable nozzle tip component may be removable so that an alternative nozzle tip may be replaced for use within the nozzle assembly. Interchangeable nozzle tips may be provided with different, dispensing openings capable of extruding beads of different shapes and sizes. For example, the nozzle tip openings may come in a range of opening sizes capable of dispensing beads of different diameters and shapes. By providing interchangeable tips, an operator will not be required to cut or shape the nozzle tip to obtain a particular nozzle opening size.

In some embodiments, it may be preferable to slide-fit the nozzle base within the housing. A retainer will be provided to prevent the nozzle assembly from disengaging from the housing when the interior of the housing is pressurized. After the contents are depressurized, and it is desired to remove the spent sausage, and the cap and nozzle assembly from the interior of cylinder housing, the nozzle assembly may be pushed inwardly into the interior of the cylinder housing along with the cap and spent sausage, for ultimate removal at the opposite end of the cylinder housing. For example, the spent sausage and nozzle assembly may be removed at the loading end of the dispensing device. In other embodiments, it will be possible to configure the housing and related coupling features so that the housing may be disengaged from the frame of the dispensing device, either for replacement with an alternative housing, for removal of a spent sausage type container, or for cleaning of the components of the device.

The foregoing are examples of certain aspects of the present invention. Many other embodiments, including modifications and variations thereof, are also possible and will become apparent to those skilled in the art upon a review of the invention as described herein. Accordingly, all suitable modifications, variations and equivalents may be resorted to, and such modifications, variations and equivalents are intended to fall within the scope of the invention as described herein and within the scope of any issued patent claims.

I claim:

1. A hand held dispensing device comprising:

a cylindrical housing defining a sealable chamber for receiving: a cylindrical container of dispensable viscous fluid and a plunger unattached to the housing for expressing the viscous fluid from, the cylindrical container, the sealable chamber extending along a longitudinal axis and between a first end and a second end of the housing;

a nozzle adjacent the first end of the housing, the nozzle comprising a variable flow valve operating between a closed position and an open position;

a hand operated first control for operating the valve between the closed position and the open position;

a conduit for communication of a pressurized fluid with the plunger, to move the plunger away from the second end toward the first end when the cylindrical container and the plunger are sealed within the chamber; and a hand operated second control for introducing the pressurized fluid into the conduit.

2. The dispensing device claimed in claim 1 defining a reservoir for pressurized gas, and the conduit communicating with the reservoir.

3. The dispensing device claimed in claim 2 wherein the reservoir is a prefilled gas cylinder.

4. The dispensing device claimed in claim 2 comprising an air valve for coupling the reservoir with an external pressurized air supply.

5. The dispensing device claimed in claim 2 wherein the reservoir receives a prefilled gas cylinder for fluid communication with the conduit.

6. The dispensing device as claimed in claim 2, wherein the reservoir is defined by a handle grip receiving pressurized air from a hand operated pump.

7. The dispensing device as claimed in claim 6, wherein the hand operated pump is mounted on the handle grip.

8. The dispensing device as claimed in claim 7, the hand operated pump comprising a pump lever moving between a storage position adjacent the handle grip and a pumping position where the pump lever projects away from the handle grip.

9. The dispensing device as claimed in claim 2, the chamber permitting pressurized gas to surround a rigid sleeve defined by the container and an exposed surface of the plunger.

10. The dispensing device as claimed in claim 1, the valve operating within a range of selectable positions between the closed position and the open position.

11. The dispensing device as claimed in claim 10, the nozzle defining a channel along a second longitudinal axis for dispensing the viscous fluid, and the valve defining a spindle channel rotating about a third axis transverse to the second longitudinal axis.

12. The dispensing device as claimed 11, comprising a control element operable by one hand and operatively connected to the first and second hand operated controls.

13. The dispensing device as claimed in claim 12, wherein the control element is a trigger.

14. The dispensing device as claimed in claim 10 comprising the plunger, the plunger forming an annular seal positioned between the plunger and a complimentary inner wall of the housing.

15. The dispensing device as claimed in claim 14, wherein the plunger abuts against the inner wall of the housing.

16. The dispensing device as claimed in claim 15, wherein the plunger defines a recess for gathering a folded wall of the container, the container defining a collapsible tube.

17. The dispensing device as claimed in claim 16, the recess defining an annular ring adjacent the periphery of the plunger.

18. The dispensing device as claimed in claim 16, the recess defining a concave surface converging at a depression on an inner wall of the plunger, adjacent the first longitudinal axis.

19. The dispensing device as claimed in claim 14, wherein the seal abuts against a rigid inner wall of the container.

20. The dispensing device as claimed in claim 10, comprising a regulator for reducing an operating pressure of the pressurized fluid flowing within the conduit to a pre-selected level, the pressurized fluid being a gas.

21. The dispensing device as claimed in claim 20, wherein the pre-selected level is adjustable by an operator.

22. The dispensing device as claimed in claim 10 comprising a removable chamber cap adjacent the second end, the chamber cap defining a re-closable seal for removably loading the cylindrical container into the housing.

23. In the dispensing device as claimed in claim 22, the chamber cap supports a cutting tool for a preformed nozzle tip projecting from a rigid end wall of the cylindrical container.

24. In the dispensing device as claimed in claim 23, the chamber cap engages the rigid end wall of the container, to center the tool for cutting engagement with the preformed nozzle tip.

25. In the dispensing device as claimed in claim 1, the nozzle extending along the longitudinal axis and defining a path for fluid communication between the first end and a nozzle base, and the nozzle base detachably securing the nozzle relative to the dispensing device for interchangeable replacement with another nozzle.

26. In the dispensing device claimed in claim 25, the variable flow valve comprises a valve spindle rotating within a preformed valve housing extending transversely through the longitudinal axis, and the valve spindle operatively associating the variable flow valve with the hand operated first control.

27. In the dispensing device claimed in claim 25, the nozzle base is received within the cylindrical housing when the nozzle is detachably secured to the dispensing device.

28. In the dispensing device claimed in claim 1, the nozzle detaching relative to the dispensing device by withdrawing the nozzle through the interior of the cylindrical housing and away from the first end.

29. In the dispensing device claimed in claim 1, the dispensing device comprising: a storage reservoir for receiving a replaceable supply of a pressurized fluid from an external source; and a handle grip extending from the cylindrical housing, the hand operated first control and the hand operated second control being adjacent to the handle grip.

30. In the dispensing device claimed in claim 29, the external source being selected from the group consisting of (1) a replaceable pressurized gas cylinder received by the storage reservoir, and (2) a hand operated air pump.

31. In the dispensing device claimed in claim 1, the hand operated second control introducing the pressurized gas into the conduit at an effective operating pressure, without a pre-set pressure regulator.

32. A hand held portable caulking type gun comprising:

a sealable cylindrical housing extending along a first longitudinal axis and between a first dispensing end and a second end; the housing defining a sealable chamber for receiving (i) a tubular container of dispensable viscous fluid and (ii) a removable plunger for movement along the first longitudinal axis, away from the second end toward the dispensing end, to express the viscous fluid from the tubular container;

a nozzle assembly secured adjacent the dispensing end, for fluid communication with the tubular container, the nozzle assembly comprising a nozzle valve operating within a range of partially open positions defined between a closed position and an open position;

a hand operated first control for operating the valve within the range of partially open positions;

a conduit for compressed gas to communicate with the plunger, to move the plunger toward the dispensing end when the cylindrical container and the plunger are sealed within the sealable chamber; and a hand operated second control for releasing the compressed gas into the conduit.

33. The caulking type gun claimed in claim 32 wherein the nozzle assembly is a first nozzle assembly detachable from the housing, for replacement with a second nozzle assembly.

34. The caulking type gun as claimed in claim 32 wherein the housing is defined by a plurality of modular components comprising: an elongated sleeve extending between the dispensing end and the second end; and the nozzle assembly.

35. The caulking type gun as claimed in claim 34, the modular components further comprising a removable chamber cap defining a sealable end wall adjacent the second end.

36. The caulking type gun as claimed in claim 35, the modular components further comprising the plunger, the plunger defining a recess for gathering a foldable outer wall of a collapsible tubular container.

37. The caulking type gun as claimed in claim 36, the modular components further comprising a removable funnel defining a path for movement of viscous material between an open end of the tubular container and an inlet to the nozzle assembly.

38. The caulking type gun as claimed in claim 35, wherein the removable chamber cap is a first chamber cap defining a first sealable chamber portion extending a first distance along the first longitudinal axis and the first chamber cap is replaceable with a second removable chamber cap defining a second sealable chamber portion extending a second distance along the first longitudinal axis, the second distance being greater than the first distance.

39. The caulking type gun as claimed in claim 32, the sealable chamber allowing the compressed gas to surround: (i) a rigid sleeve defined by the container and (ii) an exposed surface of the plunger, the plunger being slide fit within the rigid sleeve.

40. The caulking type gun as claimed in claim 32, the conduit being in fluid communication with a reservoir for storing the compressed gas, the reservoir being defined by a handle grip.

41. The caulking type gun as claimed in claim 40, the reservoir being a removable compressed gas cartridge.

42. The caulking type gun as claimed in claim 41 comprising a regulator valve, communicating with the conduit, for controlling an operating pressure of the compressed gas flowing into the sealable chamber.

43. The caulking type gun as claimed in claim 42 comprising a relief valve for exhausting the compressed gas from the sealable chamber when the operating pressure exceeds a preset limit.

44. The caulking type gun as claimed in claim 32, the first hand operated control and the second hand operated control are operatively linked by a common control element.

45. A portable caulking gun comprising:

a sealable tubular housing, extending along a first longitudinal axis, for receiving: (i) a tubular container of dispensable viscous fluid and (ii) a removable plunger to express the viscous fluid from the tubular container by the plunger sliding along the axis toward a first dispensing end of the housing and away from a second end of the housing;

a nozzle assembly secured adjacent the dispensing end, for fluid communication with the tubular container, the nozzle assembly comprising a nozzle valve operating within a range of variable flow rates;

a hand operated first control for operating the nozzle valve within the range of variable flow rates; and a hand operated second control for introducing pressurized gas into a conduit for fluid communication with an exposed surface of the plunger when the tubular container and the plunger are sealed within the housing.

46. The caulking gun as claimed in claim 45, the housing permitting the pressurized gas to surround: (i) a rigid sleeve defined by the tubular container, and (ii) the exposed surface, to slide the plunger within the sleeve.

47. The caulking gun as claimed in claim 45, comprising the plunger, the plunger defining a gas tight seal around the exposed surface, to push a collapsible wall of the container toward the first dispensing end.

48. The caulking gun as claimed in claim 47, the plunger defining a recess for gathering a folded portion of the collapsible wall of the container.

49. The caulking gun as claimed in claim 45, wherein the first and second hand operated controls are operatively linked by a common control element.

50. The caulking gun as claimed in claim 45, wherein the nozzle assembly defines a reclosable interior tapered channel for fluid communication between the tubular container and an opening defined at a dispensing tip attached to the nozzle assembly.

51. The caulking gun as claimed in claim 50, wherein the dispensing tip is replaceable with a second dispensing tip.

52. The caulking gun as claimed in claim 45, wherein the nozzle valve comprises a spindle rotatable about an axis transverse to the longitudinal axis, the spindle defining a rotatable portion of a channel for fluid communication between the tubular container and a dispensing tip attached to the nozzle assembly.

53. The caulking gun as claimed in claim 45, wherein the first control operates the nozzle valve between an open position and a closed position at a variable rate.

54. The caulking gun as claimed in claim 53, wherein the first control comprises a flexible member operatively connecting a finger activated control to the nozzle valve.

55. The caulking gun as claimed in claim 45, wherein the nozzle valve comprises a rotatable valve spindle defining a channel for fluid communication between a dispensing tip and the tubular container, and the first control comprises a cam operatively associated with a finger activated control, for rotation of the valve spindle at a variable rate.

56. The caulking gun as claimed in claim 45, wherein the first control comprises a biased linkage for operating the nozzle valve between an open position and a closed postion.

57. The caulking gun as claimed in claim 56, wherein the biased linkage comprises a spring for urging the nozzle valve toward the closed position.

58. The caulking gun as claimed in claim 45, comprising a reservoir for storing the pressurized gas.

59. The caulking gun as claimed in claim 58, wherein the reservoir is a replaceable storage cylinder.

60. The caulking gun as claimed in claim 59, comprising a regulator for reducing an operating pressure of the pressurized gas flowing into the conduit.

61. The caulking gun as claimed in claim 58, wherein the reservoir comprises a storage compartment for pressurized gas defined by the housing.

62. The caulking gun as claimed in claim 61, wherein the housing is replaceable with a second housing.

63. The caulking gun as claimed in claim 58, wherein the reservoir receives pressurized gas from a hand operated pump.

64. The caulking gun as claimed in claim 63, comprising the hand operated pump.

65. The caulking gun as claimed in claim 58, wherein the first control and the second control are operatively connected with a common control element for simultaneously closing fluid communication of the pressurized gas into the conduit and closing the nozzle valve to prevent expression of the viscous fluid via the nozzle assembly.

66. The caulking gun as claimed in claim 65, comprising a relief valve for exhausting the pressurized gas away from the exposed surface of the plunger, the relief valve operating between: (i) a first position allowing the pressurized gas to communicate with the exposed surface; (ii) a second position for exhausting the pressurized gas by operator activation; and (iii) a third position for exhausting the pressurized gas when an operating pressure of the gas exceeds a predetermined pressure level.

67. The caulking gun as claimed in claim 45, wherein the housing is replaceable with a second housing.

68. The caulking gun as claimed in claim 67, wherein the second housing defines an extendable sleeve for receiving the tubular container.

69. The caulking gun as claimed in claim 45, comprising a relief valve for exhausting the pressurized gas away from the exposed surface of the plunger.

70. The caulking gun as claimed in claim 69, the relief valve operating between: (i) a first position allowing the pressurized gas to communicate with the exposed surface; (ii) a second position for exhausting the pressurized gas by operator activation; and (iii) a third position for exhausting the pressurized gas when an operating pressure of the gas exceeds a predetermined pressure level.

71. The caulking gun as claimed in claim 70, wherein the relief valve is biased toward the first position.

72. The caulking gun as claimed in claim 71, the relief valve comprising a deformable seal for releasing the relief valve from the first position to the third position.

73. A portable caulking gun comprising:

a sealable tubular housing, extending along a first longitudinal axis, between a dispensing end and an opposing end, for receiving a coaxially aligned tubular container of dispensable viscous fluid;

a nozzle assembly adjacent the dispensing end, for viscous fluid communication with the tubular container, the nozzle assembly comprising a nozzle valve operating between an open position and a closed position;

a control for operating the nozzle valve between the open and closed positions;

a reservoir for storing compressed air received from a hand operated air pump; and a conduit for communication of the compressed air between the reservoir and the housing to express the viscous fluid from within the housing.

74. The caulking gun as claimed in claim 73 comprising the air pump.

75. The caulking gun as claimed in claim 73, the housing permitting the compressed air to surround: (i) a rigid sleeve defined by the tubular container, and (ii) an exposed surface of a slidable plunger within the sleeve.

76. The caulking gun as claimed in claim 73, comprising a plunger forming a gas tight seal around the exposed surface, to push a collapsible wall of the tubular container toward the dispensing end.

77. The caulking gun as claimed in claim 76, the plunger defining a recess for gathering a folded portion of the collapsible wall of the tubular container.

78. The caulking gun as claimed in claim 77, wherein the recess receives a crimped seal at a closed end of the tubular container.

79. The caulking gun as claimed in claim 73, wherein the nozzle valve operates within a variable range of openings between the open and closed positions.

80. The caulking gun as claimed in claim 79, wherein the nozzle valve comprises a rotatable valve spindle defining a channel for viscous fluid communication between the tubular container and a dispensing tip adjacent the dispensing end.

* * * * *